US009451794B2

(12) United States Patent
Lin

(10) Patent No.: US 9,451,794 B2
(45) Date of Patent: Sep. 27, 2016

(54) THREE-DIMENSIONALLY TAILORED POUCH STRUCTURE FOR MEN'S BRIEFS

(71) Applicant: Wen-Chien Lin, Taichung (TW)

(72) Inventor: Wen-Chien Lin, Taichung (TW)

( * ) Notice: Subject to any disclaimer, the term of this patent is extended or adjusted under 35 U.S.C. 154(b) by 366 days.

(21) Appl. No.: 14/071,772

(22) Filed: Nov. 5, 2013

(65) Prior Publication Data

US 2014/0059744 A1 Mar. 6, 2014

(30) Foreign Application Priority Data

Nov. 21, 2012 (TW) ..... 101143386 A
Apr. 8, 2013 (TW) ..... 102206289 U

(51) Int. Cl.
*A41B 9/00* (2006.01)
*A41B 9/02* (2006.01)

(52) U.S. Cl.
CPC ..... *A41B 9/023* (2013.01); *A41B 2300/32* (2013.01)

(58) Field of Classification Search
CPC .. A41B 9/002; A41B 9/023; A41B 2300/32; A41D 7/005; A61F 13/471
USPC ..... 2/400–402, 404; 602/61, 67–68, 70, 73
See application file for complete search history.

(56) References Cited

U.S. PATENT DOCUMENTS 1,477,187 A * 12/1923 Rayne ..... A61F 5/40 602/71
3,517,666 A * 6/1970 Atlee ..... A41B 9/02 2/403
4,675,012 A * 6/1987 Rooyakkers ..... A61F 5/4401 604/349
6,061,840 A * 5/2000 Alligator ..... A41B 9/002 2/400
6,105,174 A * 8/2000 Nygren ..... A61F 5/453 2/400
6,487,728 B1 * 12/2002 Cook ..... A41B 9/023 2/403
7,024,703 B1 * 4/2006 Della Ratta ..... A41B 9/023 2/400
7,676,853 B1 * 3/2010 Cutlip ..... A41B 9/023 2/400
7,788,739 B1 * 9/2010 Della Ratta ..... A41B 9/023 2/400
2004/0231034 A1 * 11/2004 Cym ..... A41B 9/023 2/403
2009/0288240 A1 * 11/2009 Lim ..... A41B 9/023 2/403
2013/0090621 A1 * 4/2013 Delattre ..... A61F 13/471 604/385.01

* cited by examiner

*Primary Examiner* — Khaled Annis
(74) *Attorney, Agent, or Firm* — Alan D. Kamrath; Kamrath IP Lawfirm, P.A.

(57) ABSTRACT

A three-dimensionally tailored pouch structure for men's briefs includes a first receiving space for receiving a wearer's penis and a second receiving space for receiving the wearer's scrotum. A vent is formed between the first and second receiving spaces for communicating the two receiving spaces with an outer space. By providing the first and second receiving spaces on the pouch structure, the wearer's penis and scrotum can be isolated from each other. Also the vent allows convection to occur between ambient air and the first and second receiving spaces, so that the two receiving spaces of the pouch structure are always dry and comfortable in touch.

10 Claims, 27 Drawing Sheets

THREE-DIMENSIONALLY TAILORED POUCH STRUCTURE FOR MEN'S BRIEFS

FIELD OF THE INVENTION

The present invention relates to a pouch structure and, more particularly, to a three-dimensionally tailored pouch structure attached to men's briefs for receiving a wearer's penis and scrotum therein.

BACKGROUND OF THE INVENTION

In addition to fabric material, design is another important factor for men's briefs to have comfortableness to wear.

Currently, there is a type of men's briefs designed with a pouch. This type of men's briefs is featured by a pouch that is located in front of or below a crotch of the men's briefs to provide a suitably large space for loosely enclosing a wearer's penis and scrotum therein, so that surfaces of the penis and scrotum are isolated from the wearer's skin at the crotch and two thighs. With the pouch, the briefs become more comfortable for wearing, and the surfaces of the penis and scrotum are protected against injury due to frequent frictional contact with the thighs when walking or taking exercise over a long period of time. Also, with this type of men's briefs with a pouch, the wearer's penis and scrotum are not subjected to discomfort caused by damp and hot air in the briefs.

SUMMARY OF THE INVENTION

A primary object of the present invention is to provide a three-dimensionally tailored pouch structure attached to men's briefs for receiving a wearer's penis and scrotum in two separated spaces and always keeping the pouch structure dry and comfortable in touch.

To achieve the above and other objects, the three-dimensionally tailored pouch structure for men's briefs according to an embodiment of the present invention includes a connecting opening, a first receiving space communicating with the connecting opening for receiving a wearer's penis and enclosing a front end of the penis therein, a second receiving space located adjacent to the first receiving space and communicating with the connecting opening for receiving the wearer's scrotum therein, and a vent formed between the first and/or the second receiving space for communicating the two receiving spaces with an outer space.

Preferably, the connecting opening is connected to a crotch front opening on the briefs to form an integral part of the men's briefs.

Preferably, the pouch structure is formed by cutting a single piece of fabric into a W-shaped fabric having a first panel and a second panel, which are laterally symmetrical and shaped like triangles, and a notch formed between the first panel and the second panel.

Preferably, the pouch structure further includes an encircling strip portion and a bendable panel portion located below the encircling strip portion and having a folding line, along which the bendable panel portion adjoins the encircling strip portion.

Preferably, the bendable panel portion includes a first outer bendable panel, a second outer bendable panel, a first inner bendable panel and a second inner bendable panel. The encircling strip portion is connected to the first and second outer bendable panels as well as the first and second inner bendable panels. The first outer and inner bendable panels are laterally symmetrical to the second outer and inner bendable panels, respectively.

Preferably, the encircling strip portion has a sewing edge that forms the connecting opening, a first lateral edge connected at two ends to an end of the sewing edge and of the folding line, and a second lateral edge connected at two ends to another opposite end of the sewing edge and of the folding line and for sewing to the first lateral edge. The first outer bendable panel is extended from an end of the folding line and has a first outer edge, which is connected at an end to the first lateral edge, and at least a first cutting line, which includes a first upper segment and a first lower segment. The second outer bendable panel is extended from another opposite end of the folding line and has a second outer edge, which is connected at an end to the second lateral edge and is sewed to the first outer edge, and at least a second cutting line, which includes a second upper segment and a second lower segment. The first and second outer bendable panels and the encircling strip portion together form the first receiving space. The first inner bendable panel is extended from the folding line to locate between the first and second outer bendable panels, and the second inner bendable panel is extended from the folding line to locate between the first inner bendable panel and the second outer bendable panel. The second inner bendable panel is bent by an angle to be overlapped with and sewed to the first inner bendable panel, so that the second inner bendable panel cooperates with the first inner bendable panel and the encircling strip portion to form the second receiving space.

Preferably, the first outer bendable panel is extended from the folding line opposite to the sewing edge, and the first lower segment of the first cutting line is bent by an angle toward the sewing edge. The second outer bendable panel is extended from the folding line opposite to the sewing edge, and the second lower segment of the second cutting line is bent by an angle toward the sewing edge.

Preferably, the encircling strip portion is provided near and along the first and second lateral edges with a first hook and loop fastener, via which the first and second lateral edges are detachably connected to each other. The bendable panel portion is provided near and along the first outer edge of the first outer bendable panel and the second outer edge of the second outer bendable panel with a second hook and loop fastener, via which the first and second outer edges are detachably connected to each other.

The bendable panel portion is provided along the overlapped area between the first and second inner bendable panels with a third hook and loop fastener, via which the first and second inner bendable panels are detachably connected to each other.

Preferably, the first and second inner bendable panels are substantially two triangles.

Preferably, the first and second outer bendable panels are substantially two triangles or two long strips.

Preferably, the second receiving space has a second vent for communicating it with the outer space. Preferably, the first panel has first and second cutting lines defined thereon, such that a notch is formed between the first and second cutting lines. The second panel has third and fourth cutting lines defined thereon, such that another notch is formed between the third and fourth cutting lines.

Preferably, the first and second panels have a notch formed between them.

Preferably, the first panel is formed into a first outer bendable panel and a first inner bendable panel, and the second panel is formed into a second outer bendable panel and a second inner bendable panel.

Preferably, the first and second outer bendable panels are shaped like two long strips, and the first and second inner bendable panels are shaped like two triangles.

Preferably, the encircling strip portion and the bendable panel portion together have a shape similar to a triangle or a trapezoid.

Preferably, the bendable panel portion has a shape similar to a triangle or a trapezoid.

Preferably, the connecting opening is provided with a joining element, and the crotch front opening is provided with a receiving element for correspondingly engaging with the joining element.

Preferably, the joining element is a string member or a fastening member, and the receiving element is a hole corresponding to the string member or the fastening member.

Preferably, the bendable panel portion includes first and second outer bendable panels, and a middle bendable panel located between the first and second outer bendable panel.

Preferably, a first cutting line is defined between the first outer bendable panel and the middle bendable panel, and a second cutting line is defined between the second outer bendable panel and the middle bendable panel.

Preferably, the middle bendable panel is turned inward to form two bent lateral sides thereof, and, then, the two bent lateral sides are respectively sewed up to form the first receiving space. The first outer bendable panel and the second outer bendable panel are turned to overlap each other and connected at the overlapped area to form the second receiving space.

To achieve the above and other objects, the three-dimensionally tailored pouch structure for men's briefs according to another embodiment of the present invention includes a connecting opening communicable with an inner side of men's briefs, and a pouch body located below the connecting opening for receiving a wearer's penis and scrotum therein. An end of the pouch body opposite to the connecting opening is a closed end. A through hole is provided on the pouch body between the closed end and the connecting opening for communicating an inner space of the pouch body with an outer space.

Preferably, the connecting opening is connected to a crotch front opening on the men's briefs to form an integral part of the men's briefs.

Preferably, the pouch structure further includes an encircling strip portion and a bendable panel portion located below the encircling strip portion.

Preferably, the bendable panel portion includes a first panel and a second panel, which are laterally symmetrical to each other.

Preferably, the first and second panels are shaped like triangles. The first panel has a first outer edge and a first inner edge, and the second panel has a second outer edge and a second inner edge.

Preferably, the encircling strip portion has first and second lateral edges, which are connected edge to edge to form the connecting opening. The first outer edge of the first panel and the second outer edge of the second panel are connected edge to edge. A bottom portion of the first and second panels, which have been connected edge to edge at the first and second outer edges, is partially bent upward and connected to the first and the second inner edge to form the pouch body.

Preferably, the bendable panel portion is shaped like a triangle or a trapezoid, and has first and second outer edges, which are laterally symmetrical to each other. The first outer edge has a first upper segment and a first lower segment, and the second outer edge has a second upper segment and a second lower segment.

Preferably, the encircling strip portion has first and second lateral edges, which are connected edge to edge to form the connecting opening. A bottom end of the bendable panel portion is bent upward, so that the first lower segment of the first outer edge is correspondingly connected to a part of the first upper segment and the second lower segment of the first outer edge is correspondingly connected to a part of the second upper segment to thereby form the pouch body.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
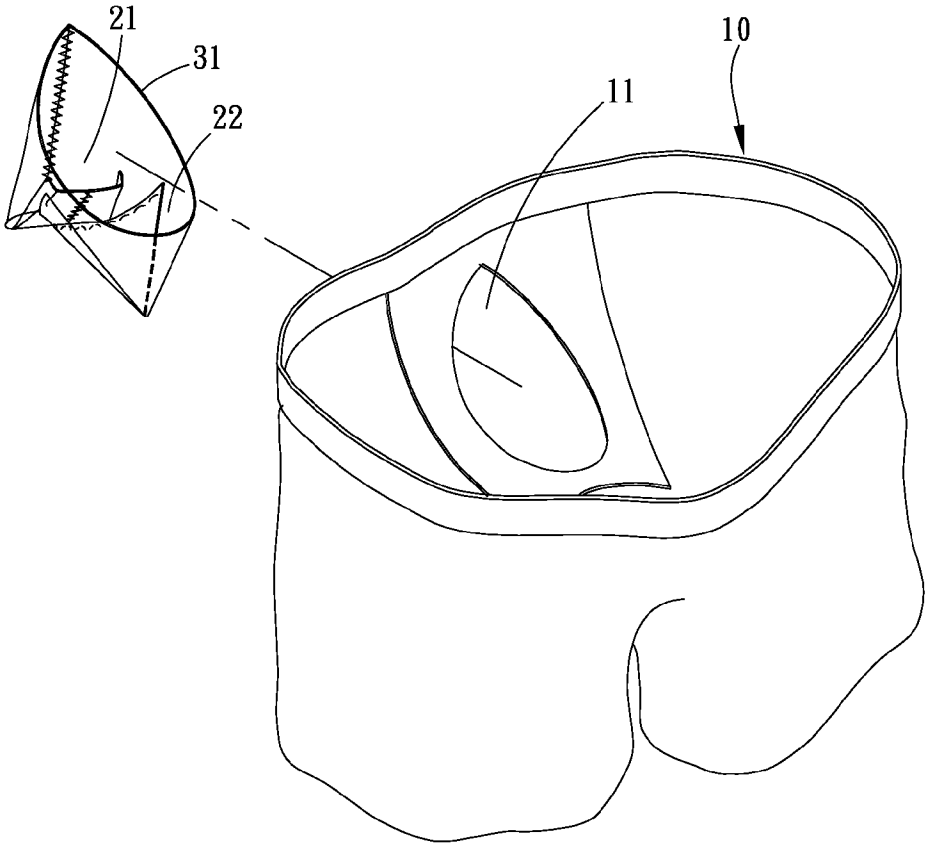
FIG. 1 is a perspective view showing a three-dimensionally tailored pouch structure for men's briefs according to a first embodiment of the present invention before it is sewed onto men's briefs.

Please refer to FIGS. 1 to 5, in which a three-dimensionally tailored pouch structure for men's briefs according to a first embodiment of the present invention is shown. For the purpose of conciseness and clarity, the present invention is also briefly referred to as "the pouch structure" herein. As can be seen in FIG. 1, the pouch structure of the present invention is designed for connecting to a front opening 11 at the crotch of men's briefs 10. In the accompanying drawings, while the illustrated men's briefs are boxer briefs, it is understood the pouch structure of the present invention can be connected to men's briefs of any other style.

Figure 2:
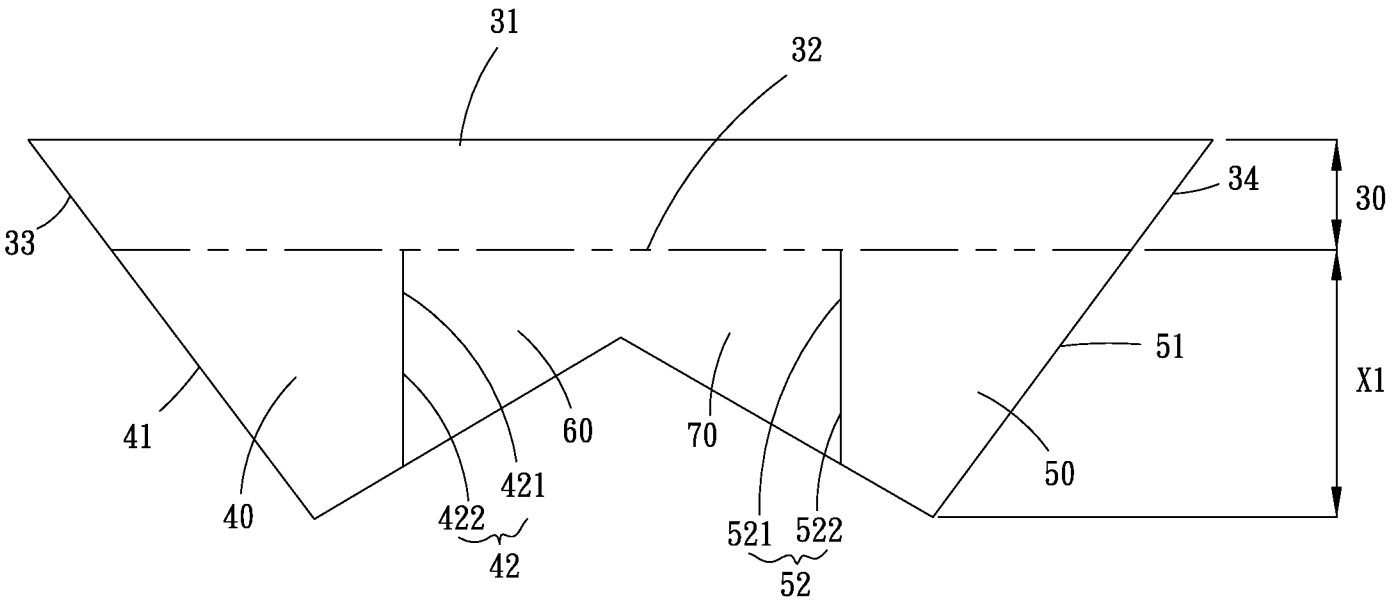
FIG. 2 is a developed view of the pouch structure of FIG. 1.
Figure 3:
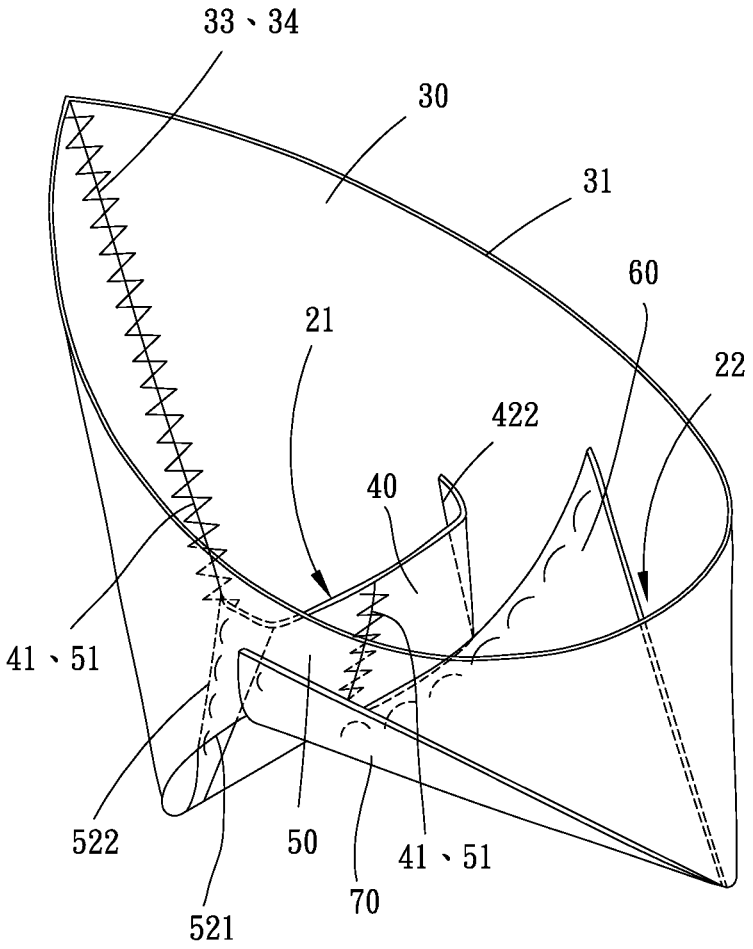
FIG. 3 is a phantom perspective view of the pouch structure according to the first embodiment of the present invention.
Figure 4:
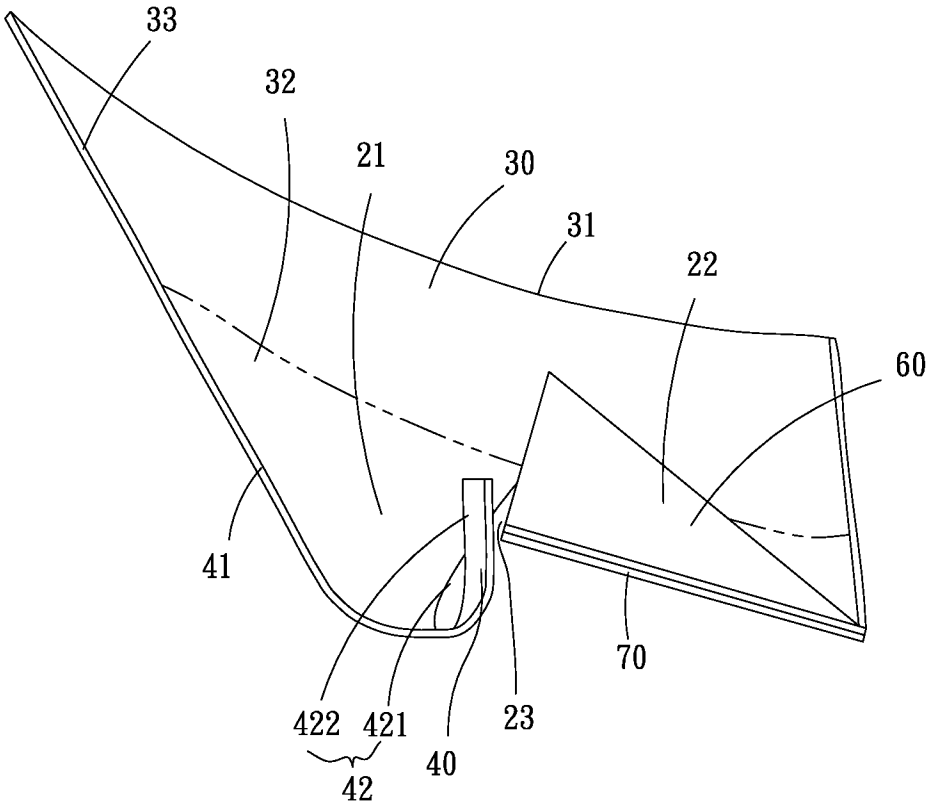
FIG. 4 is a sectional view of FIG. 3.
Figure 5:
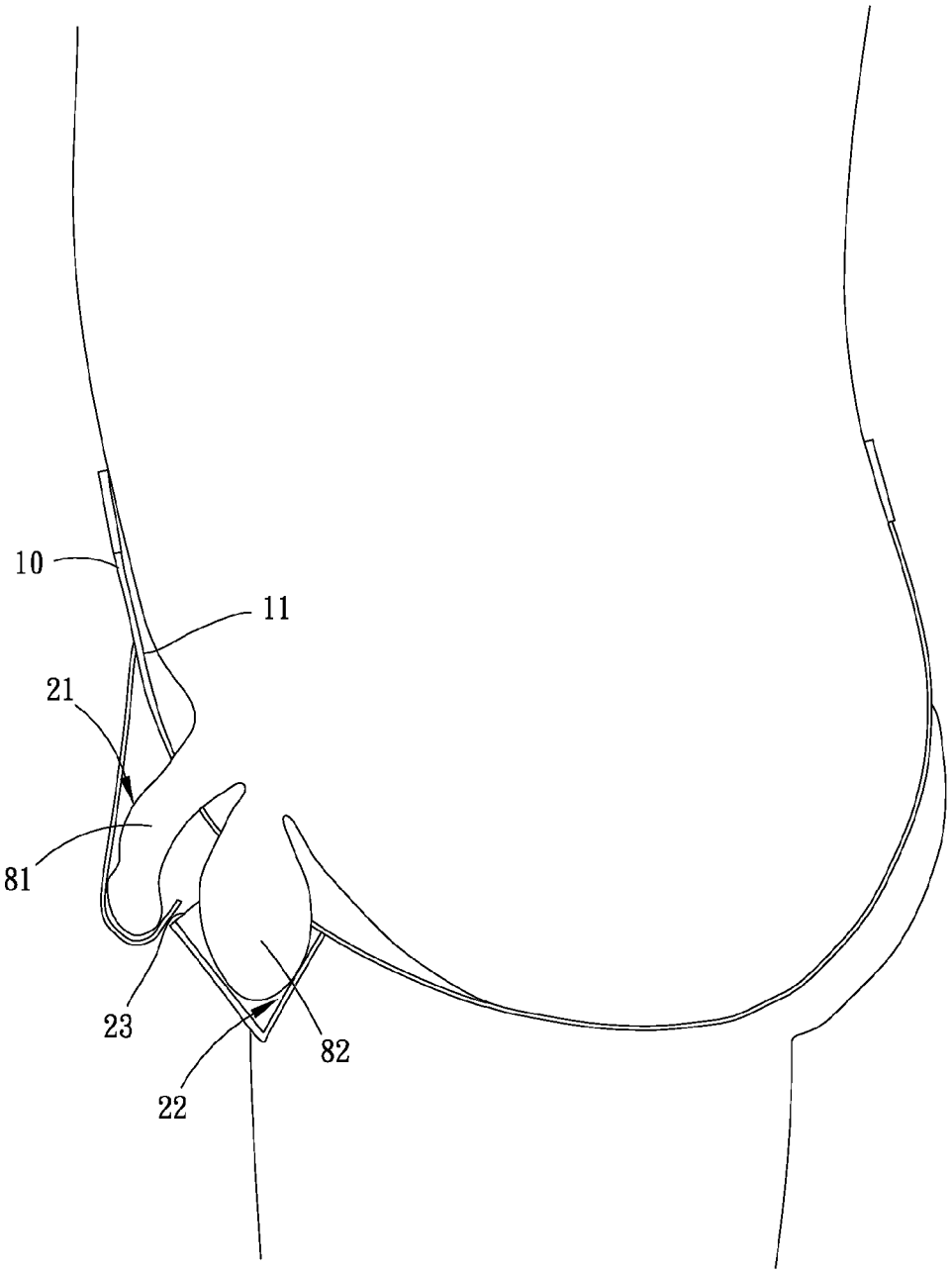
FIG. 5 is a sectional view showing the pouch structure of FIG. 3 in use.

As shown, the pouch structure according to the first embodiment of the present invention includes a connecting opening, a first receiving space 21, a second receiving space 22 and a first vent 23, and is tailored from a single piece of W-shaped fabric. As can be seen in FIG. 2, the W-shaped fabric includes an encircling strip portion 30 and a bendable panel portion X1 located adjacent to the encircling strip portion 30. The bendable panel portion X1 includes a folding line 32, along which the bendable panel portion X1 adjoins the encircling strip portion 30, and consists of a first outer bendable panel 40, a second outer bendable panel 50, a first inner bendable panel 60, and a second inner bendable panel 70.

The W-shaped fabric is cut along at least a first cutting line 42 to separate the first outer bendable panel 40 from the first inner bendable panel 60, and is cut along at least a second cutting line 52 to separate the second outer bendable panel 50 from the second inner bendable panel 70. The first and second outer bendable panels 40, 50 are laterally symmetrical to each other, and the first and second inner bendable panels 60, 70 are laterally symmetrical to each other. The first cutting line 42 includes a first upper segment 421 and a first lower segment 422, and the second cutting line 52 includes a second upper segment 521 and a second lower segment 522.

The encircling strip portion 30 has first and second lateral edges 33, 34, which are slant edges in the first embodiment of the present invention. The bendable panel portion X1 has first and second outer edges 41, 51, which are also slant edges in the first embodiment of the present invention. The W-shaped fabric is sewed up along the first and second lateral edges 33, 34 as well as the first and second outer edges 41, 51 to form a pouch body.

The first outer bendable panel 40 and the second outer bendable panel 50 are simultaneously bent inward, such that the first cutting line 42 is bent by an angle for the first upper and lower segments 421, 422 to face each other, and the second cutting line 52 is also bent by an angle for the second upper and lower segments 521, 522 to face each other. Then, the first upper and lower segments 421, 422 are sewed together and the second upper and lower segments 521, 522 are sewed together to thereby form the first receiving space 21 in the pouch body. The first receiving space 21 so formed is communicable with the connecting opening and accordingly, with an inner side of the men's briefs 10. The first receiving space 21 is adapted to receive a wearer's penis 81 and enclose a front end of the penis 81 therein for absorbing residual urine remained thereon.

The first inner bendable panel 60 and the second inner bendable panel 70 are bent to overlap each other and then sewed together to form the second receiving space 22. The second receiving space 22 adjoins the first receiving space 21, and communicates with the connecting opening and accordingly the inner side of the men's briefs 10 for receiving a wearer's scrotum 82 therein.

The first vent 23 is located between the first and second receiving spaces 21, 22, and is communicable with the pouch body and the inner side of the men's briefs 10.

The encircling strip portion 30 is integrally connected to the first outer bendable panel 40, the first inner bendable panel 60, the second inner bendable panel 70 and the second outer bendable panel 50. The encircling strip portion 30 has a sewing edge 31 defining the connecting opening, and the pouch structure is sewed along the sewing edge 31 to the crotch front opening 11 of the men's briefs 10. The first lateral edge 33 of the encircling strip portion 30 is connected at two ends to one end of the sewing edge 31 and of the folding line 32. The second lateral edge 34 of the encircling strip portion 30 is connected at two ends to another opposite end of the sewing edge 31 and of the folding line 32, and is sewed to the first lateral edge 33.

The first outer bendable panel 40 is extended from one end of the folding line 32 in a direction opposite to the sewing edge 31. The first outer edge 41 and the first cutting line 42 form outer and inner edges, respectively, of the first outer bendable panel 40, and the first outer edge 41 has an end connected to the first lateral edge 33. As having been mentioned above, the first cutting line 42 includes a first upper segment 421 and a first lower segment 422, which can be sewed together when the first outer bendable panel 40 is inward bent. In the illustrated first embodiment, since the first outer bendable panel 40 is extended from the folding line 32 in a direction opposite to the sewing edge 31, the first lower segment 422 of the first cutting line 42 is bent toward the sewing edge 31 by an angle when the first outer bendable panel 40 is inward curved.

The second outer bendable panel 50 is extended from another opposite end of the folding line 32 in a direction opposite to the sewing edge 31. The second outer edge 51 and the second cutting line 52 form outer and inner edges, respectively, of the second outer bendable panel 50, and the second outer edge 51 has an end connected to the second lateral edge 34. As having been mentioned above, the second cutting line 52 includes a second upper segment 521 and a second lower segment 522, which can be sewed together when the second outer bendable panel 50 is inward bent. In the illustrated first embodiment, since the second outer bendable panel 50 is extended from the folding line 32 in a direction opposite to the sewing edge 31, the second lower segment 522 of the second cutting line 52 is bent toward the sewing edge 31 by an angle when the second outer bendable panel 50 is inward curved.

The first inner bendable panel 60 is extended from the folding line 32 opposite to the sewing edge 31 to locate between the first and second outer bendable panels 40, 50.

The second inner bendable panel 70 is extended from the folding line 32 opposite to the sewing edge 31 to locate between the first inner bendable panel 60 and the second outer bendable panel 50. The second inner bendable panel 70 is sideward bent by an angle to overlap with and be sewed to the first inner bendable panel 60, such that the first inner bendable panel 60, the second inner bendable panel 70 and the encircling strip portion 30 together form the second receiving space 22.

With the above arrangements, the three-dimensionally tailored pouch structure for men's briefs according to the first embodiment of the present invention is adapted to receive the wearer's penis 81 and scrotum 82 at the same time, isolating the surfaces of the penis 81 and the scrotum 82 from the skin at the wearer's thighs and crotch, and making the men's briefs more comfortable for wear.

It is noted the pouch structure according to the first embodiment of the present invention includes two receiving spaces, namely, the first receiving space 21 for receiving the penis 81 therein, and the second receiving space 22 for receiving the scrotum 82 therein. Therefore, a man wearing the briefs having the pouch structure of the present invention will find the briefs are always dry, clean and comfortable in touch, because his penis 81 and scrotum 82 are isolated from each other.

It is also noted the pouch structure according to the first embodiment of the present invention has a first vent 23 provided between the first and second receiving spaces 21, 22. With the first vent 23, convection occurs between ambient air and the first receiving space 21, the second receiving spaces 22 and the brief 10 to effectively reduce the damp and hot feeling when wearing the brief. Further, by outward lifting a portion of the pouch structure at the first vent 23, the wearer can conveniently expose the penis 81 from the first receiving space 21 via the first vent 23 for the purpose of urinating.

Figure 6A:
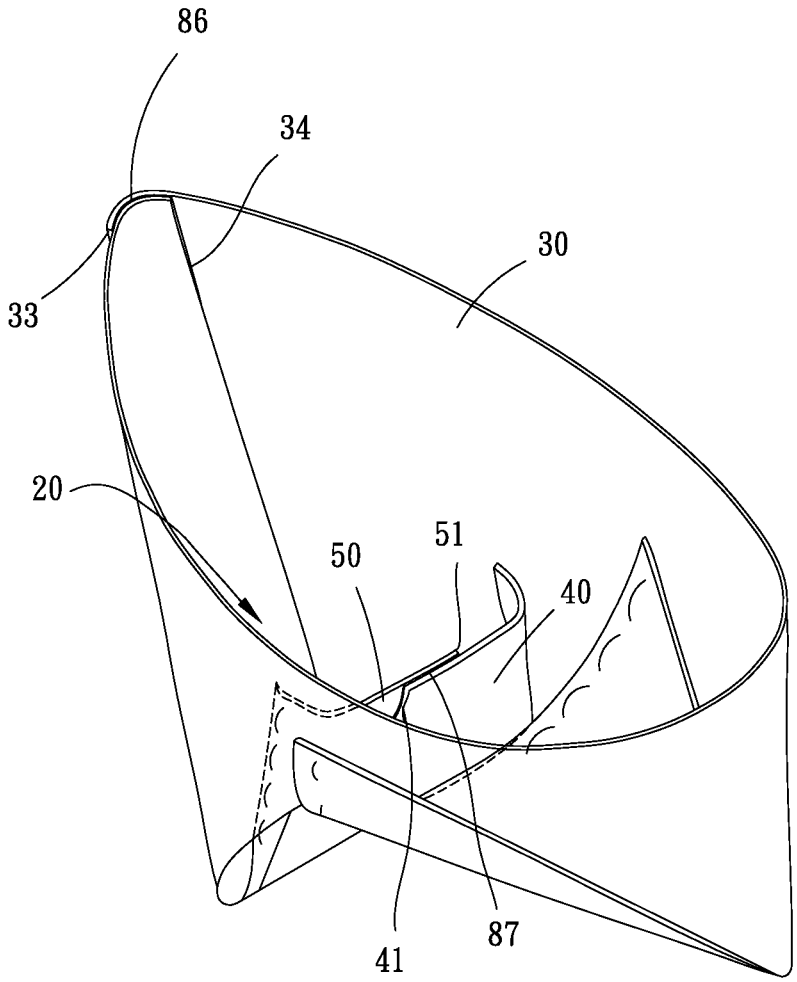
FIG. 6A is a phantom perspective view of a first variant of the pouch structure of FIG. 3.

According to the present invention, different edges of the bendable panel portion X1 and the encircling strip portion 30 can be connected together by other ways without being limited to sewing. For example, as can be seen in FIG. 6A, which is a phantom perspective view of a first variant of the pouch structure according to the first embodiment of the present invention, a first hook and loop fastener 86 is provided on the encircling strip portion 30 near and along the first and second lateral edges 33, 34 to detachably connect the first and second lateral edges 33, 34 together, and a second hook and loop fastener 87 is provided on the first and second outer bendable panels 40, 50 near and along the first and second outer edges 41, 51 to detachably connect the first and second outer edges 41, 51 together. In this manner, the first receiving space 21 can be adjusted in size as necessary by changing an overlapped area between the first and second lateral edges 33, 34 of the encircling strip portion 30 as well as an overlapped area between the first outer edge 41 of the first outer bendable panel 40 and the second outer edge 51 of the second outer bendable panel 50.

Figure 6B:
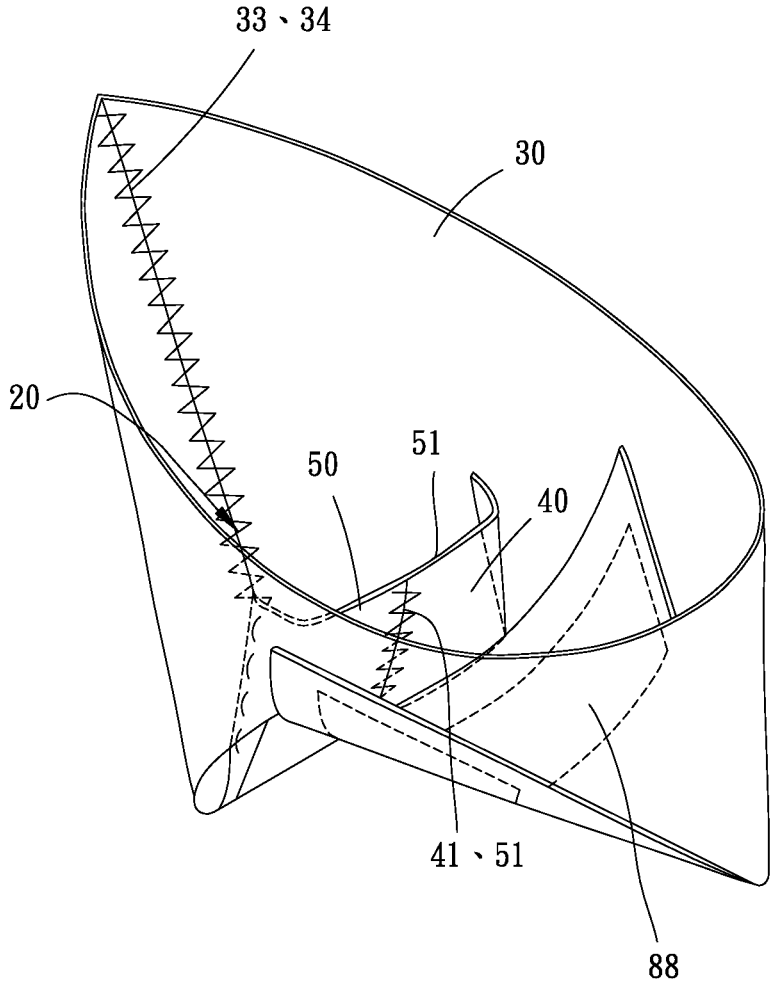
FIG. 6B is a phantom perspective view of a second variant of the pouch structure of FIG. 3.

In a second variant of the pouch structure according to the first embodiment of the present invention as shown in FIG. 6B, a third hook and loop fastener 88 is provided on the first and second inner bendable panels 60, 70 at the overlapped area between them, such that the first and second inner bendable panels 60, 70 are detachably connected to allow size adjustment of the second receiving space 22.

Figure 6C:
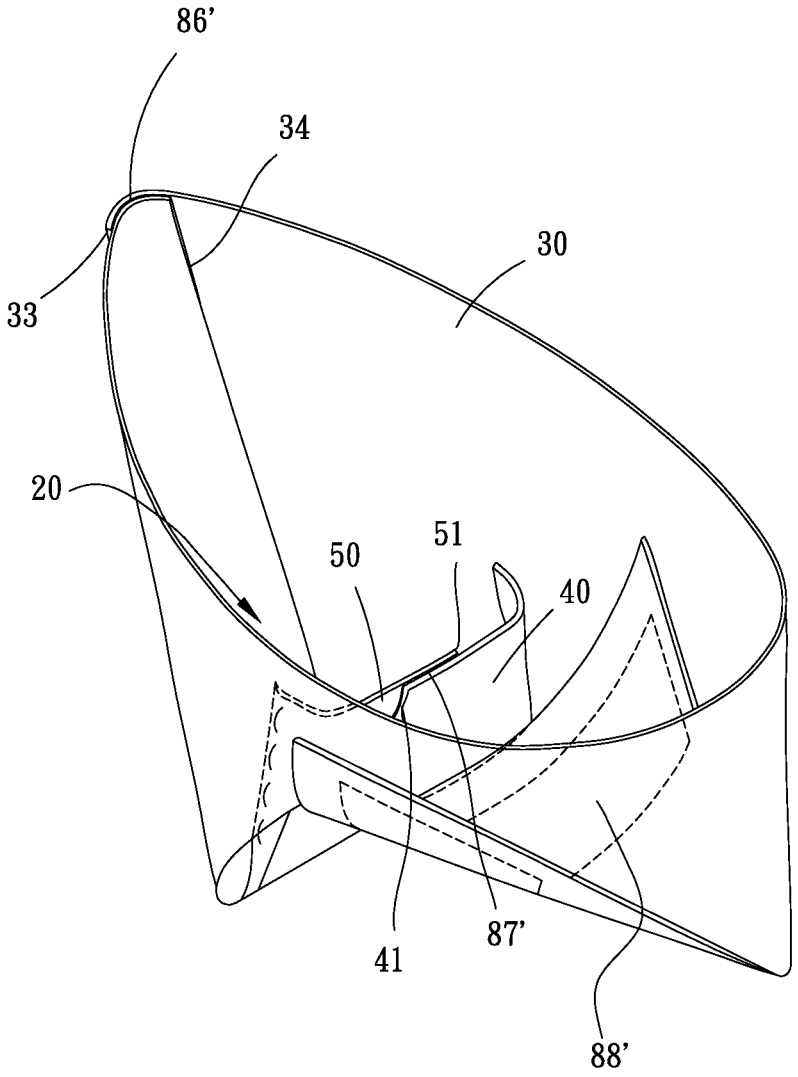
FIG. 6C is a phantom perspective view of a third variant of the pouch structure of FIG. 3.

In a third variant of the pouch structure according to the first embodiment of the present invention as shown in FIG. 6C, a first hook and loop fastener 86' is provided on the encircling strip portion 30 near and along the first and second lateral edges 33, 34 to detachably connect the first and second lateral edges 33, 34 together, a second hook and loop fastener 87' is provided on the first and second outer bendable panels 40, 50 near and along the first and second outer edges 41, 51 to detachably connect the first and second outer edges 41, 51 together, and a third hook and loop fastener 88' is provided on the first and second inner bendable panels 60, 70 at the overlapped area between them. With the first and second hook and loop fasteners 86', 87', the first receiving space 21 can be adjusted in size, and with the third hook and loop fastener 88', the second receiving space 22 can be adjusted in size.

Figure 7:
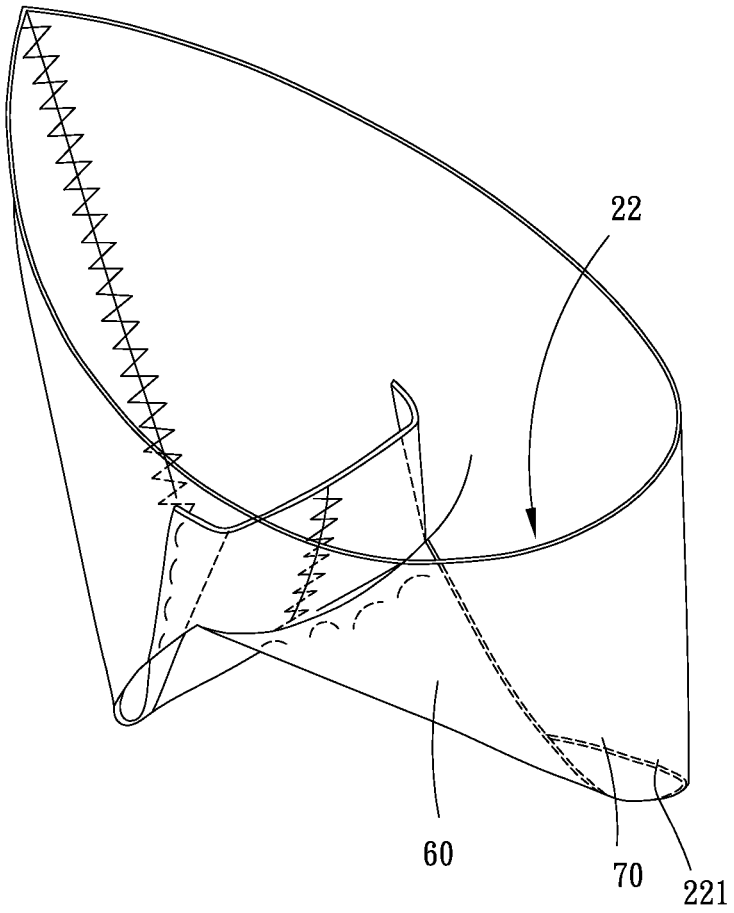
FIG. 7 is a phantom perspective view of a fourth variant of the pouch structure of FIG. 3.

FIG. 7 is a phantom perspective view of a fourth variant of the pouch structure according to the first embodiment of the present invention. As shown, in the fourth variant of the first embodiment, the second inner bendable panel 70 is bent by a predetermined angle and sewed onto the first inner bendable panel 60, such that the second receiving space 22 is formed with a second vent 221, via which the second receiving space 22 is communicable with a space outside the pouch structure. With the second vent 221, convection occurs between ambient air and the second receiving space 22 to effectively reduce the damp and hot feeling when wearing the briefs.

Figure 8:
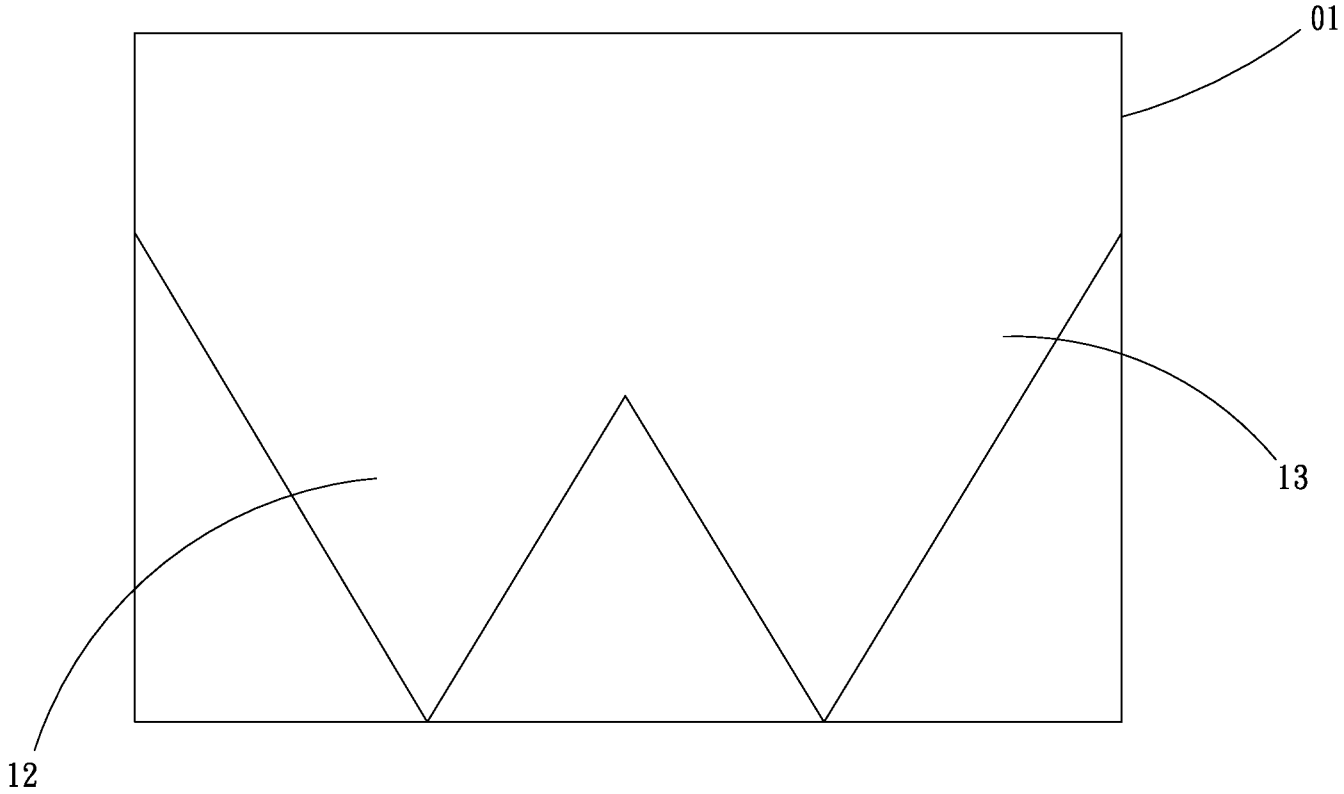
FIGS. 8 to 10 show a manner of cutting a single piece of fabric for forming a three-dimensionally tailored pouch structure for men's briefs according to the first embodiment of the present invention.
Figure 9:
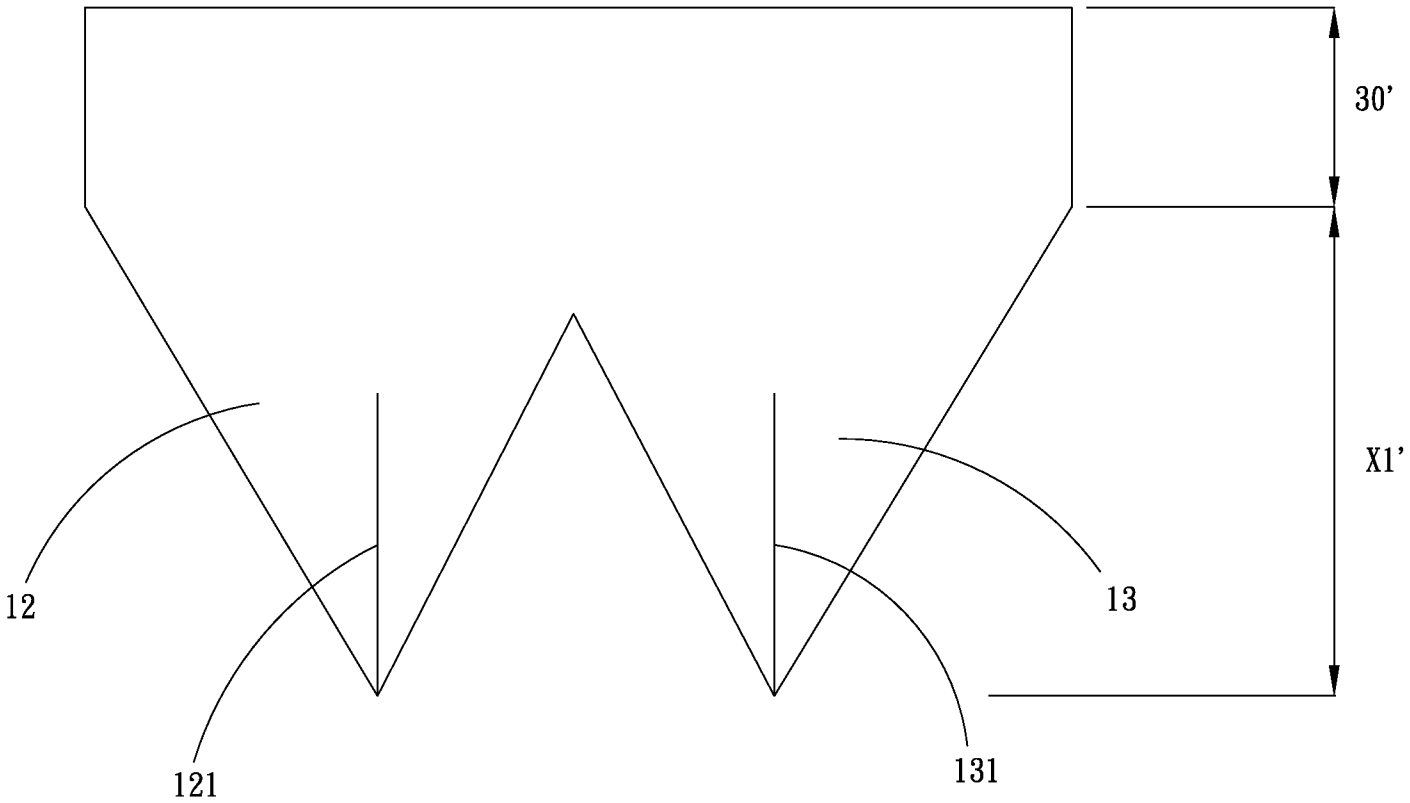
Figure 10:
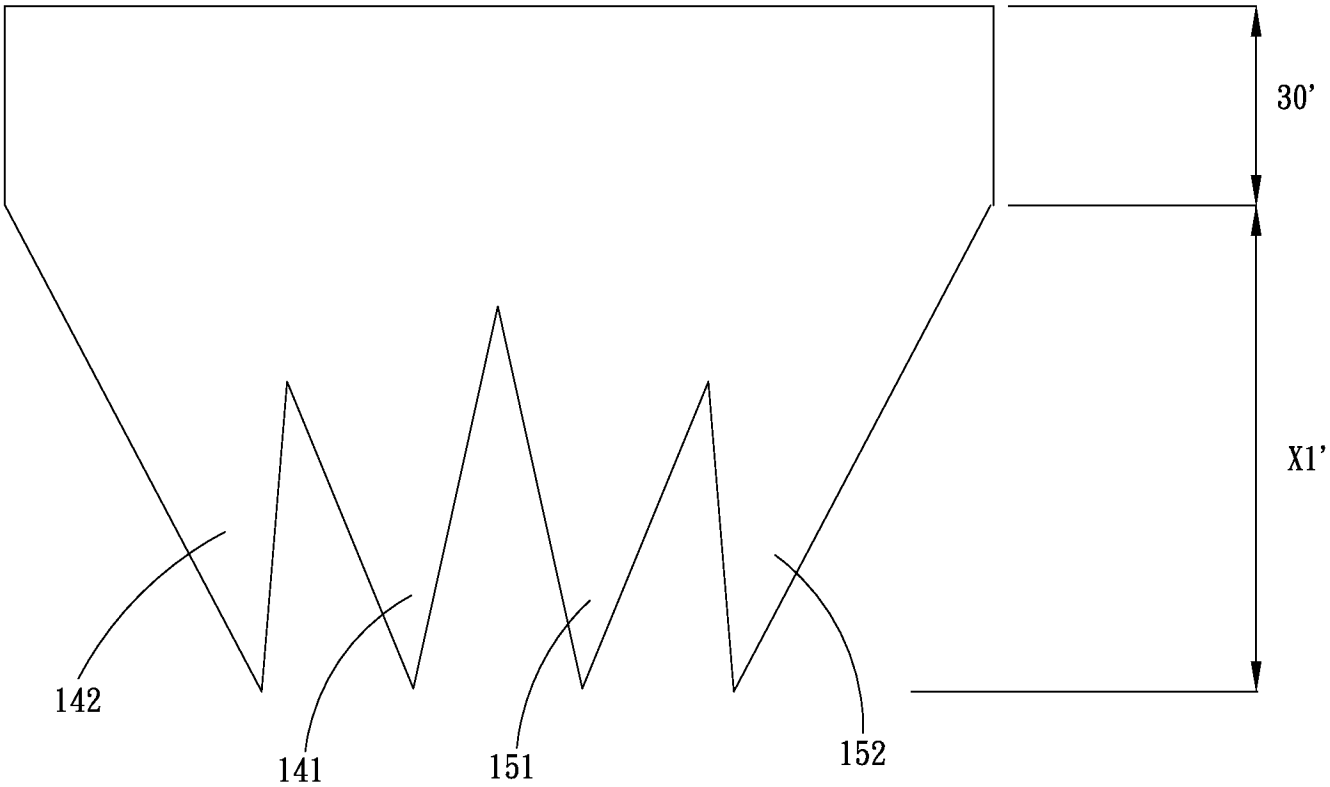

According to the present invention, the three-dimensionally tailored pouch structure for men's briefs according to the first embodiment of the present invention is not necessarily formed from the W-shaped fabric shown in FIG. 2, but can be otherwise formed by cutting a single piece of flat material 01 as shown in FIGS. 8 to 10. For example, the flat material 01 can be a complete piece of fabric as shown in FIG. 8, which can be cut into a W-shaped piece to obtain an encircling strip portion 30' and a bendable panel portion X1', as shown in FIG. 9. The bendable panel portion X1' includes a first panel 12 and a second panel 13, which are laterally symmetrical and shaped like two triangles.

On the first panel 12, there is defined at least a first cutting line 121, which is extended from a vertex of the triangular first panel 12 by a predetermined length. Similarly, on the second panel 13, there is defined at least a second cutting line 131, which is extended from a vertex of the triangular second panel 13 by a predetermined length.

As shown in FIG. 10, by cutting along the first and second cutting lines 121, 131, the first panel 12 is separated into a smaller first inner bendable panel 141 and a larger first outer bendable panel 142, and the second panel 13 is separated into a smaller second inner bendable panel 151 and a larger second outer bendable panel 152.

While the first inner bendable panels 60, 141, the second inner bendable panels 70, 151, the first outer bendable panels 40, 142, and the second outer bendable panels 50, 152 illustrated in the accompanying drawings are triangles in shape, it is understood these bendable panels are not necessarily limited to triangles but may be differently shaped.

Figure 11:
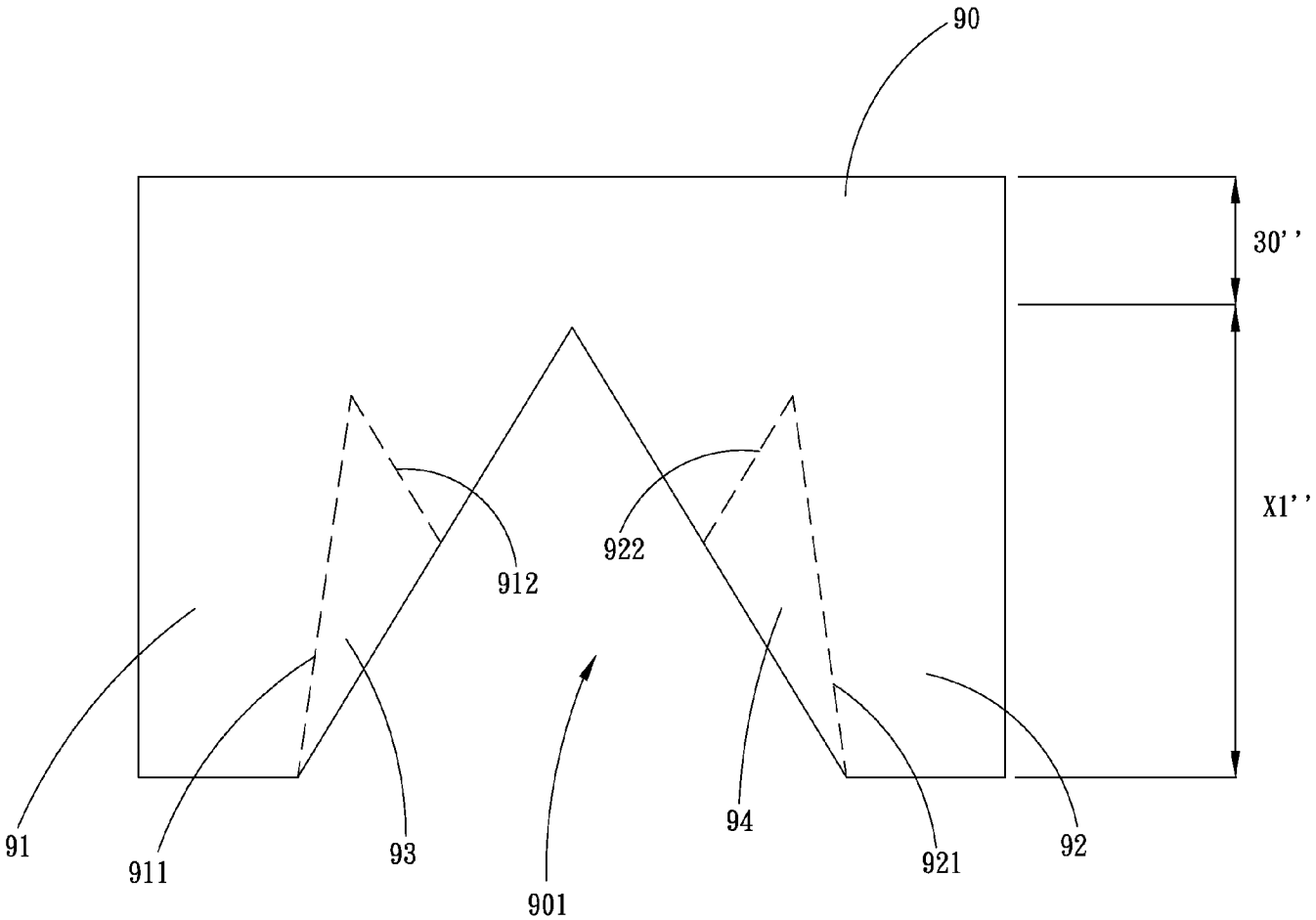
FIGS. 11 and 12 show another manner of cutting a piece of fabric for forming a three-dimensionally tailored pouch structure for men's briefs according to the first embodiment of the present invention.
Figure 12:
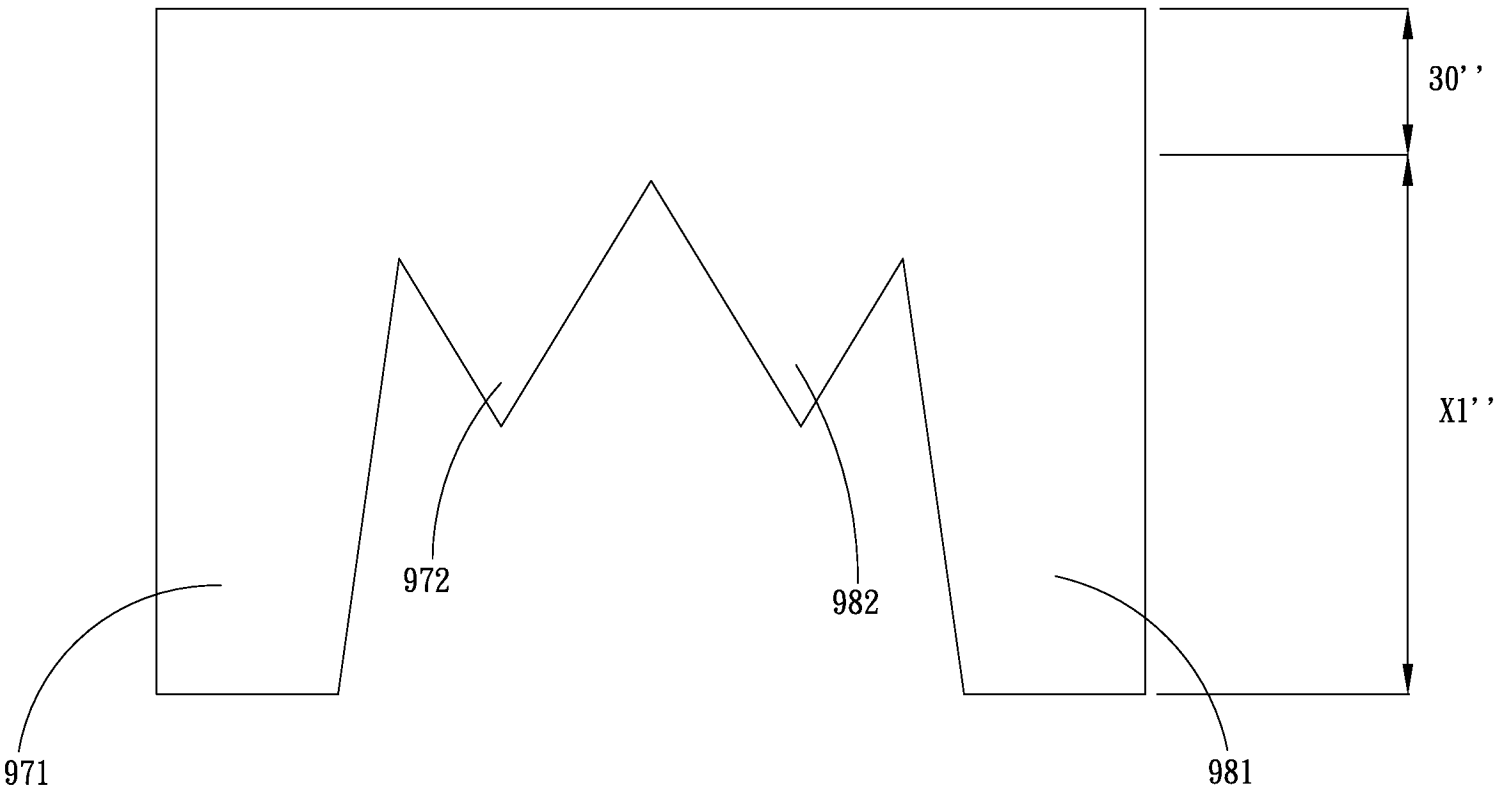

FIGS. 11 and 12 show another manner of cutting a piece of fabric to obtain two inner bendable panels and two outer bendable panels. As shown, a piece of fabric 90 is cut to obtain an encircling strip portion 30" and a bendable panel portion X1". The bendable panel portion X1" includes a first panel 91 and a second panel 92, which are laterally symmetrical panels, and a notch 901 is formed between the first and second panels 91, 92. On the first panel 91, there are defined first and second cutting lines 911, 912, which are so arranged on the first panel 91 that they together define a triangular area 93 between them. Similarly, on the second panel 92, there are defined third and fourth cutting lines 921, 922, which are so arranged on the second panel 92 that they together define a triangular area 94 between them. By cutting along the first and second cutting lines 911, 912, the triangular area 93 is removed from the first panel 91 to form a notch thereat. Also, by cutting along the third and fourth cutting lines 921, 922, the triangular area 94 is removed from the second panel 92 to form another notch thereat.

As can be seen in FIG. 12, after being cut in the above-described manner, the first panel91 is formed into a first outer bendable panel 971 and a first inner bendable panel 972, and the second panel 92 is formed into a second outer bendable panel 981 and a second inner bendable panel 982. The first outer bendable panel 971 and the second outer bendable panel 981 are shaped like two long strips, while the first inner bendable panel 972 and the second inner bendable panel 982 are shaped like two triangles or two polygons.

Figure 13:
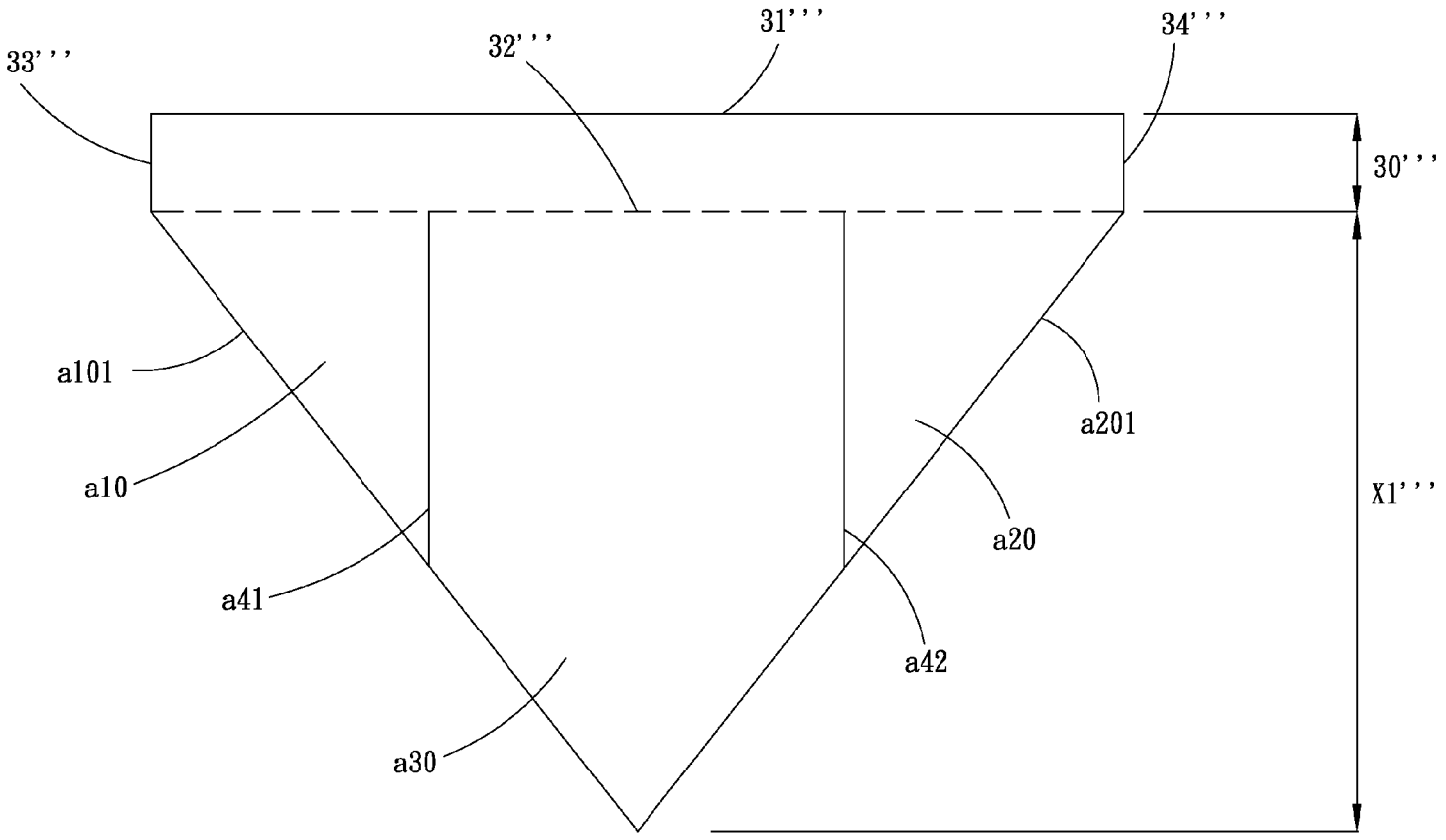
FIG. 13 shows a further manner of cutting a piece of fabric for forming a three-dimensionally tailored pouch structure for men's briefs according to the first embodiment of the present invention.
Figure 14:
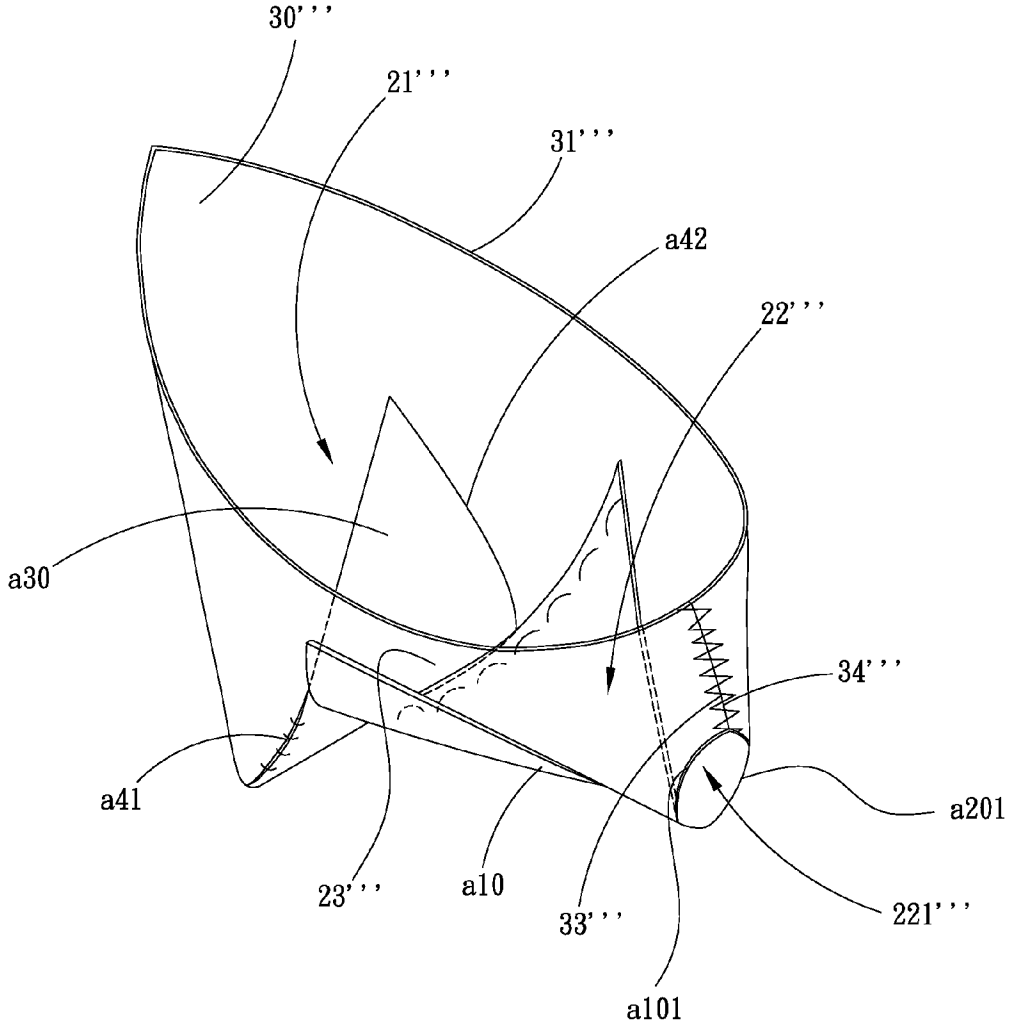
FIG. 14 is a phantom perspective view showing a three-dimensional pouch structure for men's briefs formed with the cut piece of fabric of FIG. 13.

FIG. 13 shows a further manner of cutting a piece of fabric for forming a three-dimensionally tailored pouch structure for men's briefs according to the first embodiment of the present invention, and FIG. 14 is a phantom perspective view showing the three-dimensional pouch structure for men's briefs formed with the fabric of FIG. 13. As shown, the fabric of FIG. 13 is cut to obtain an encircling strip portion 30''' and a bendable panel portion X1''' shaped like a triangle or a polygon. The encircling strip portion 30''' is similar to those in the first embodiment and the variants thereof, and includes a sewing edge 31''' for forming the connecting opening and sewing to the crotch front opening 11 of the briefs 10, a first lateral edge 33''' connected at two ends to one end of the sewing edge 31''' and of a folding line 32''' of the bendable panel portion X1''', and a second lateral edge 34''' connected at two ends to another opposite end of the sewing edge 31''' and of the folding line 32'''. The second lateral edge 34''' and the first lateral edge 33''' are to be sewed together.

The bendable panel portion X1''' adjoins the encircling strip portion 30''' with the folding line 32''' forming a border line between them. The bendable panel portion X1''' includes a first outer bendable panel a10, a second outer bendable panel a20, and a middle bendable panel a30 located between the first and second outer bendable panels a10, a20. A first cutting line a41 is defined between the first outer bendable panel a10 and the middle bendable panel a30, and a second cutting line a42 is defined between the second outer bendable panel a20 and the middle bendable panel a30. The first outer bendable panel a10 has a first outer edge a101, and the second outer bendable panel a20 has a second outer edge a201.

The middle bendable panel a30 is turned inward to bend two lateral sides thereof. Namely, the first cutting line a41, the second cutting line a42, two segments of the bent first cutting line a41 as well as two segments of the second cutting line a42 are respectively connected together by sewing or with hook and loop fasteners, to form a first receiving space 21'''. Then, the first outer bendable panel a10 and the second outer bendable panel a20 are turned to overlap each other and connected at the overlapped area to form a second receiving space 22'''. Meanwhile, the first outer edge a101, the second outer edge a201 and the folding line 32''' together enclose a space to form a second vent 221'''. Finally, a first vent 23''' is formed between the first and second receiving spaces 21''', 22'''.

Figure 15:
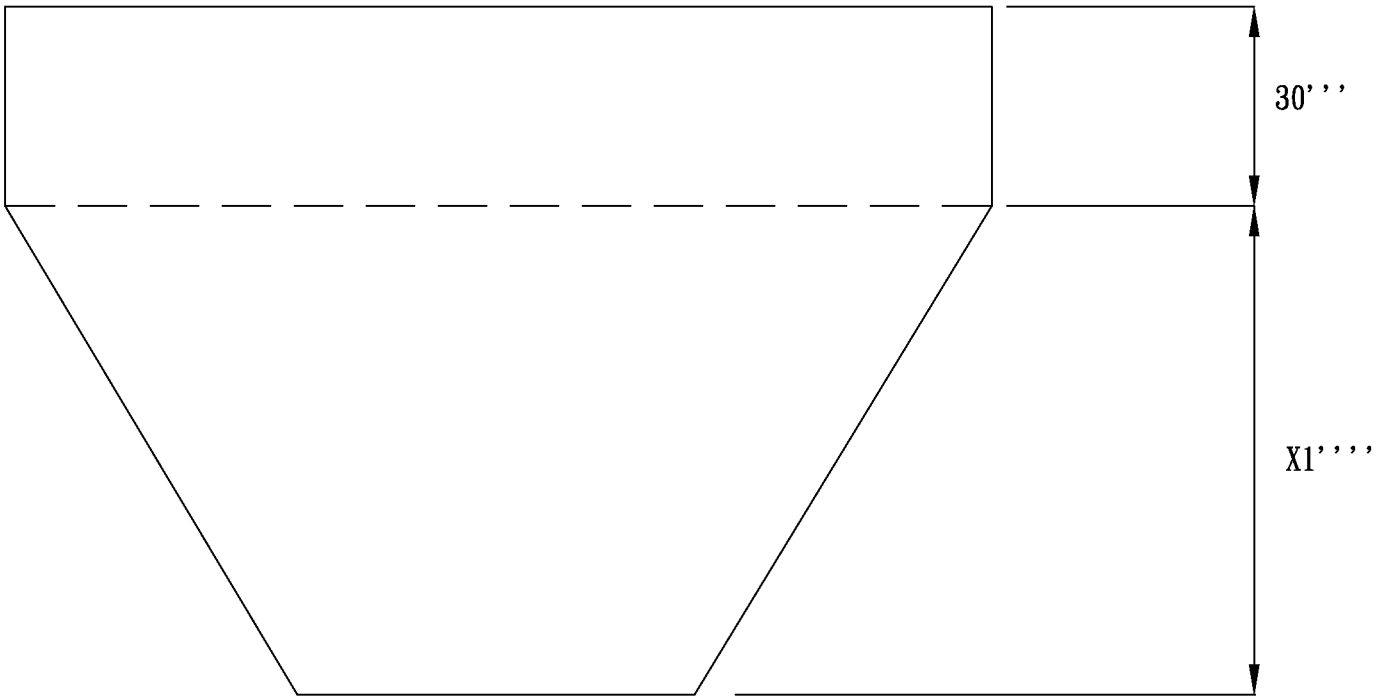
FIG. 15 shows a cut piece of fabric similar to that of FIG. 13 but having a differently shaped bendable panel portion.

While the fabric shown in FIG. 13 has a bendable panel portion X1''' shaped into a triangle, it is understood the bendable panel portion is not necessarily triangle-shaped, but can be, for example, trapezoidal in shape FIG. 15 shows a cut piece of fabric similar to that of FIG. 13 but having a trapezoidal bendable panel portion X1''''.

Figure 16:
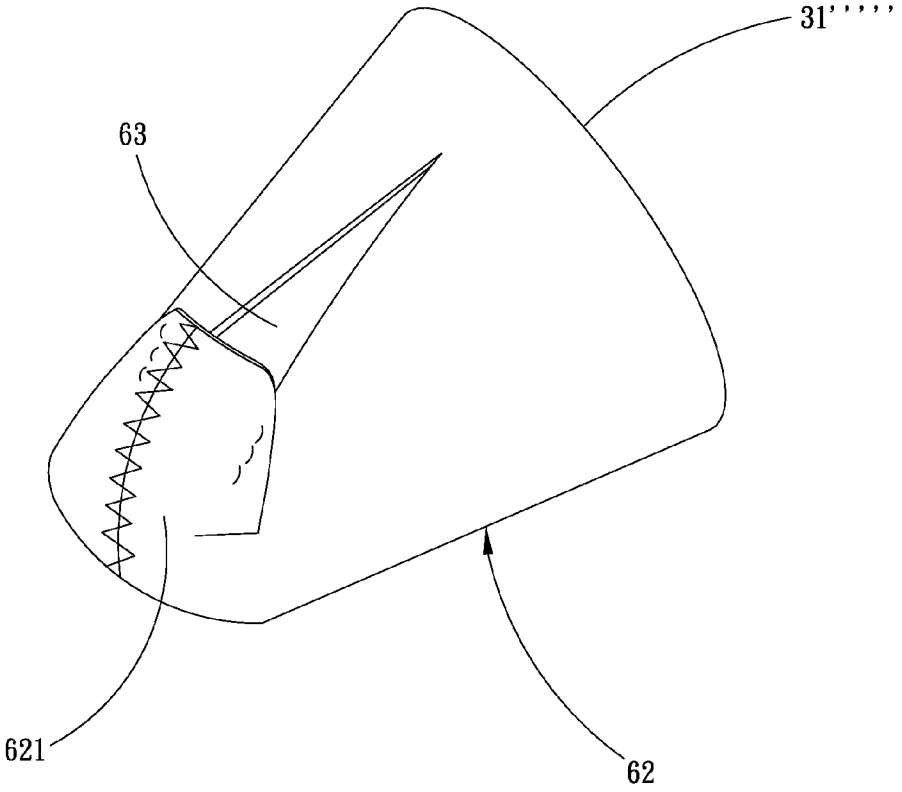
FIG. 16 is a perspective view of a three-dimensionally tailored pouch structure for men's briefs according to a second embodiment of the present invention.

Please refer to FIG. 16 that is a perspective view of a three-dimensionally tailored pouch structure for men's briefs according to a second embodiment of the present invention. As shown, the pouch structure in the second embodiment includes a connecting opening for communicating with an inner side of men's briefs, and a pouch body 62 located below the connecting opening for receiving a wearer's penis and scrotum. An end of the pouch body 62 opposite to the connecting opening is a closed end 621. A through hole 63 is left on the pouch body 62 between the closed end 621 and the connecting opening for communicating an inner space of the pouch body 62 with an outer space.

Figure 17:
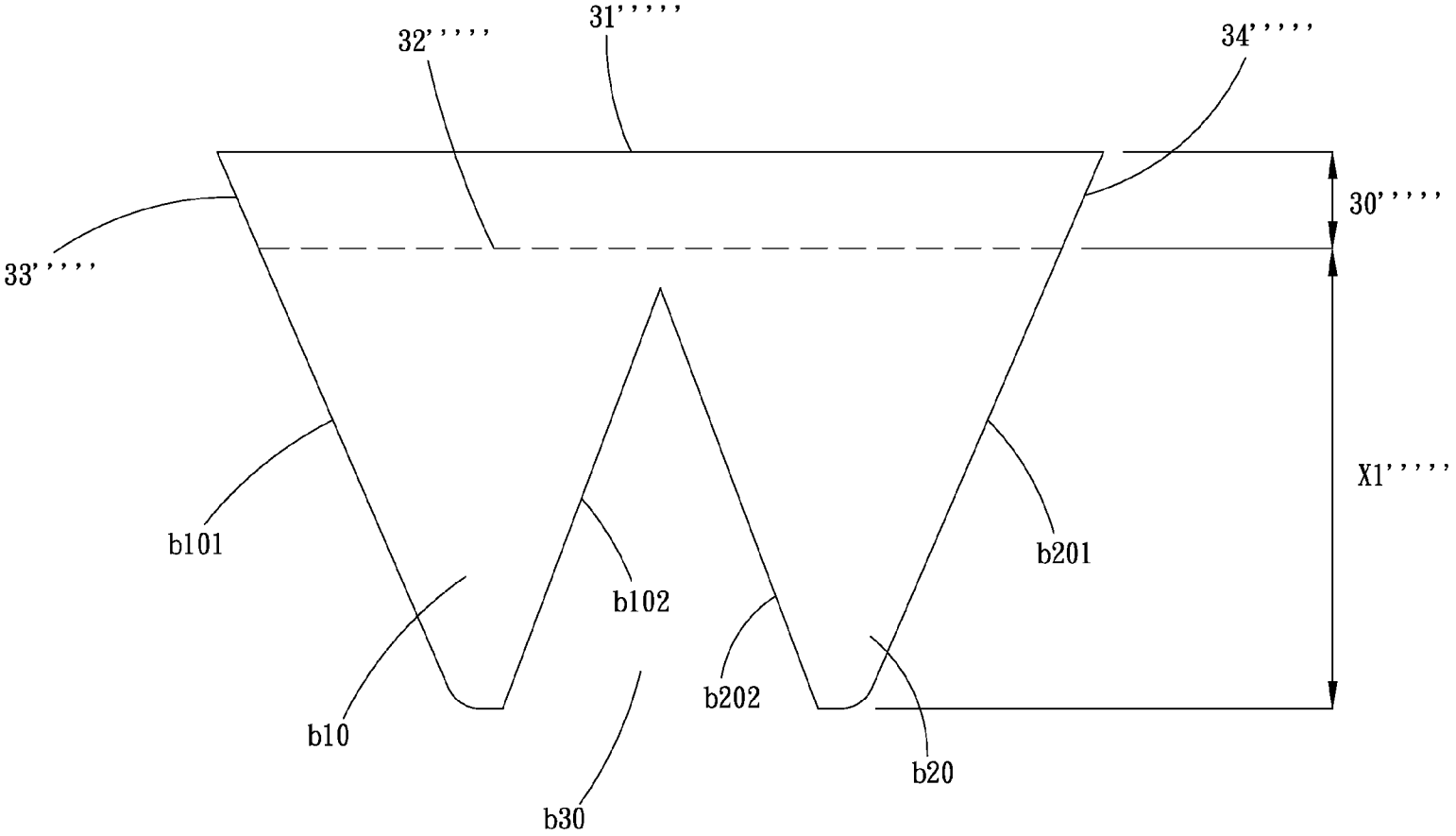
FIG. 17 is a plan view of a cut piece of fabric for forming the pouch structure of FIG. 16.
Figure 18:
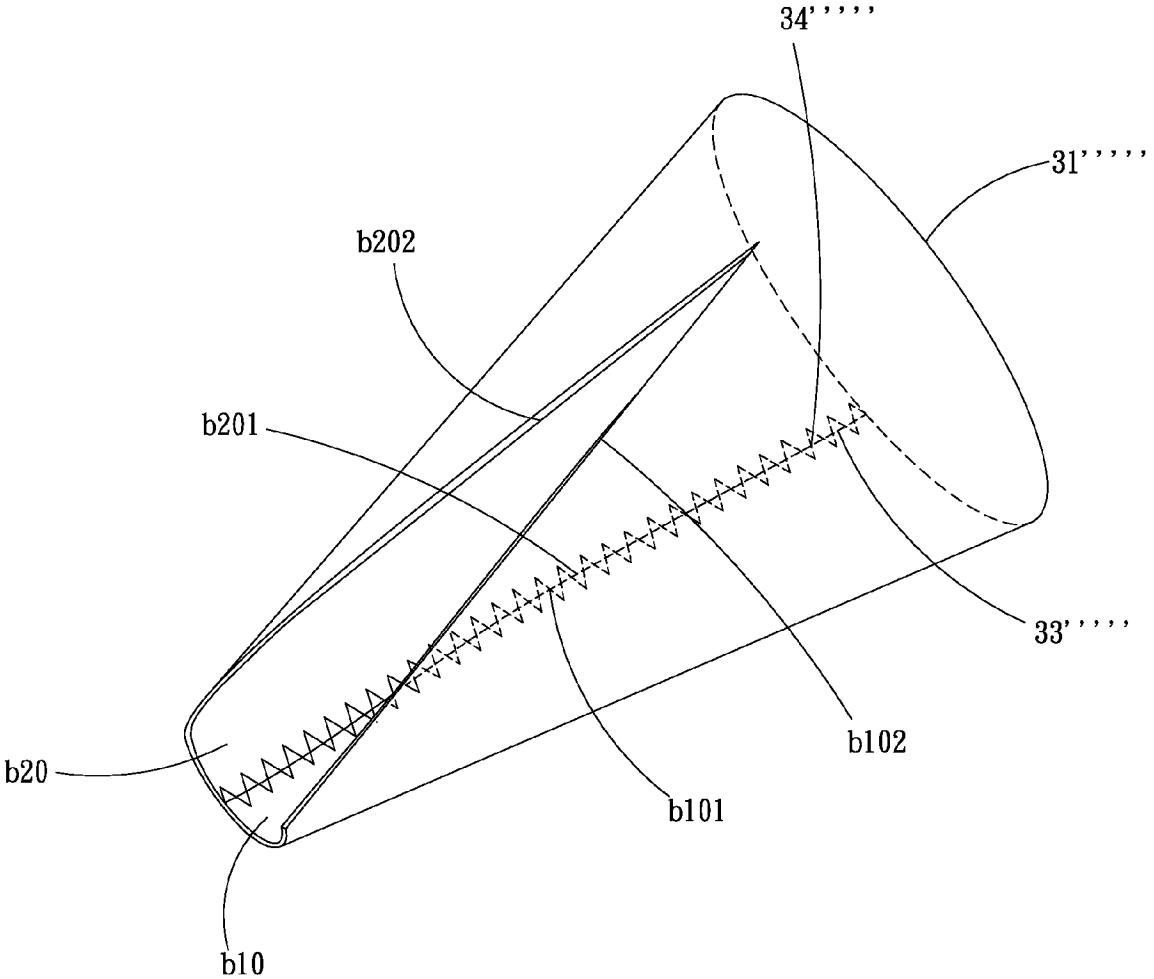
FIG. 18 is a phantom perspective view showing the pouch structure of FIG. 16 in a half-finished state.
Figure 19:
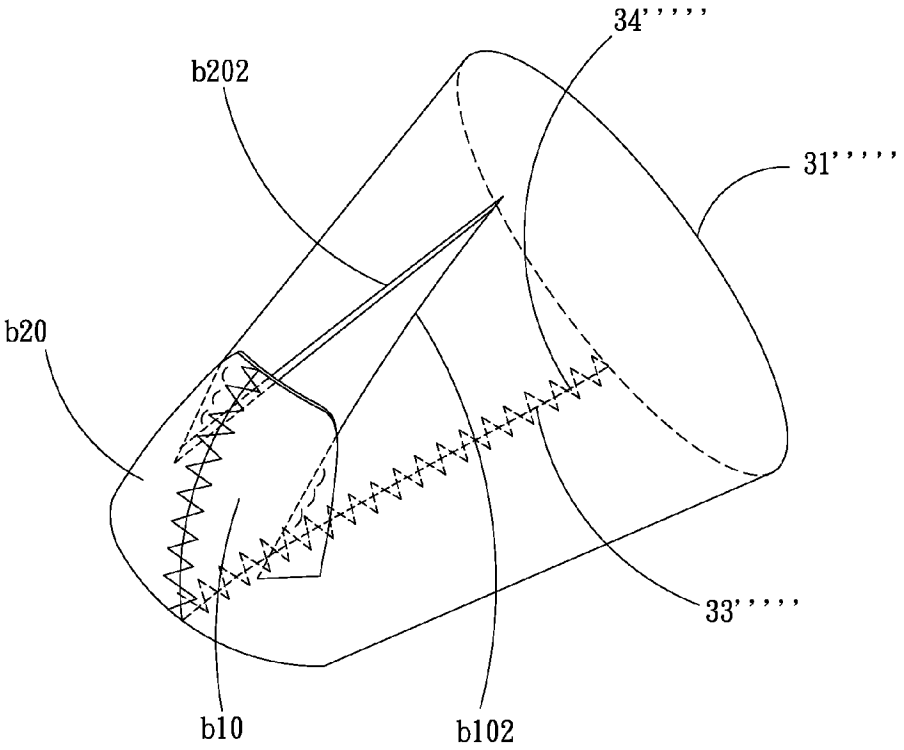
FIG. 19 is a phantom perspective view showing the pouch structure of FIG. 16 in a finished state.

Please refer to FIGS. 17 to 19. FIG. 17 is a plan view of a piece of W-shaped fabric for forming the pouch body 62 of FIG. 16. The W-shaped fabric includes an encircling strip portion 30'''' and a bendable panel portion X1''''. The bendable panel portion X1'''' includes a folding line 32'''', along which the bendable panel portion X1'''' adjoins the encircling strip portion 30''''. The encircling strip portion 30'''' is similar to those in the first embodiment and the variants thereof, and includes a sewing edge 31'''' for forming the connecting opening and sewing to the crotch front opening 11 of the briefs 10, a first lateral edge 33'''' connected at two ends to an end of the sewing edge 31'''' and of the folding line 32'''' of the bendable panel portion X1'''', and a second lateral edge 34'''' connected at two ends to another opposite end of the sewing edge 31'''' and of the folding line 32''''. The second lateral edge 34'''' and the first lateral edge 33'''' are to be sewed together.

The bendable panel portion X1'''' includes a first panel b10 and a second panel b20, which are laterally symmetrical and shaped like two triangles, such that a notch b30 is formed between the first and second panels b10, b20. The first panel b10 has a first outer edge b101 and a first inner edge b102, and the second panel b20 has a second outer edge b201 and a second inner edge b202.

To form the pouch structure according to the second embodiment of the present invention, the first lateral edge 33'''' and the second lateral edge 34'''' of the encircling strip portion 30'''' are connected edge to edge to form the connecting opening, and the first outer edge b101 of the first panel b10 and the second outer edge b201 of the second panel b20 are also connected edge to edge, as shown in FIG. 18. Then, as shown in FIG. 19, a bottom portion of the first and second panels b10, b20, which have been connected edge to edge at the first and second outer edges b101, b201, is partially bent upward and connected to the first inner edge b102 and the second inner edge b202 to complete the pouch structure.

Figure 20:
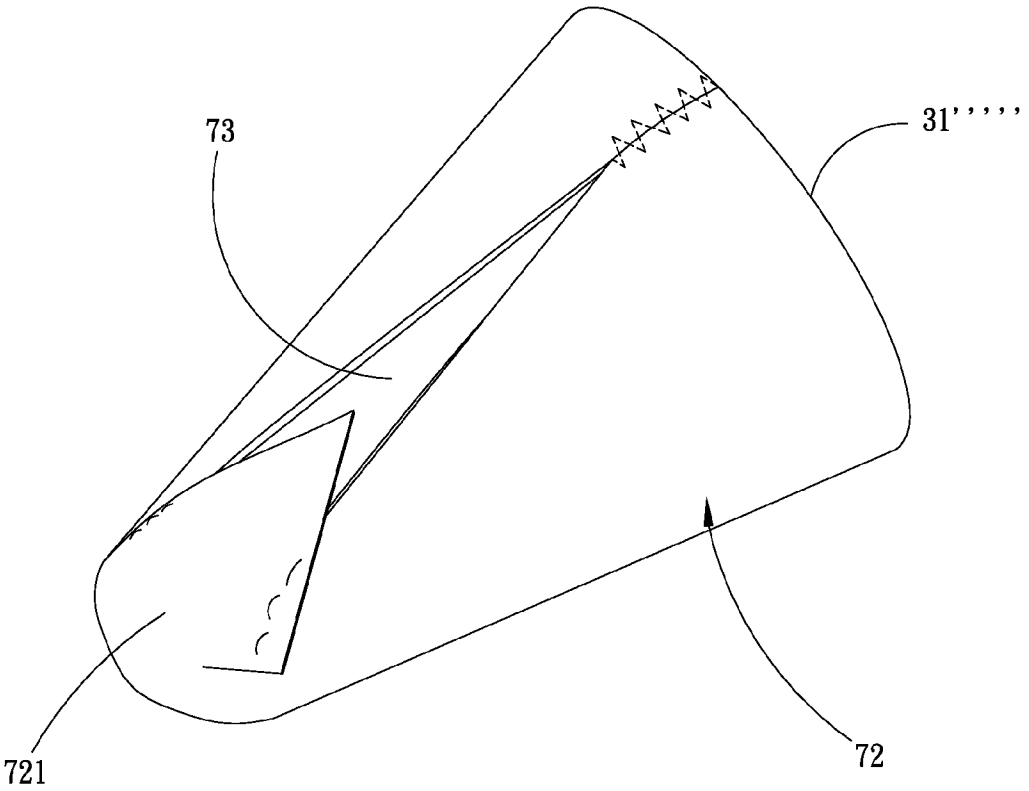
FIG. 20 is a perspective view of a variant of the three-dimensionally tailored pouch structure for men's briefs according to the second embodiment of the present invention.

FIG. 20 is a perspective view of a variant of the three-dimensionally tailored pouch structure for men's briefs according to the second embodiment of the present invention. As shown, the pouch structure in the variant of the second embodiment includes a connecting opening for communicating with an inner side of men's briefs, and a pouch body 72 located below the connecting opening for receiving a wearer's penis and scrotum. An end of the pouch body 72 opposite to the connecting opening is a closed end 721. A through hole 73 is left on the pouch body 72 between the closed end 721 and the connecting opening for communicating an inner space of the pouch body 72 with an outer space.

Figure 21:
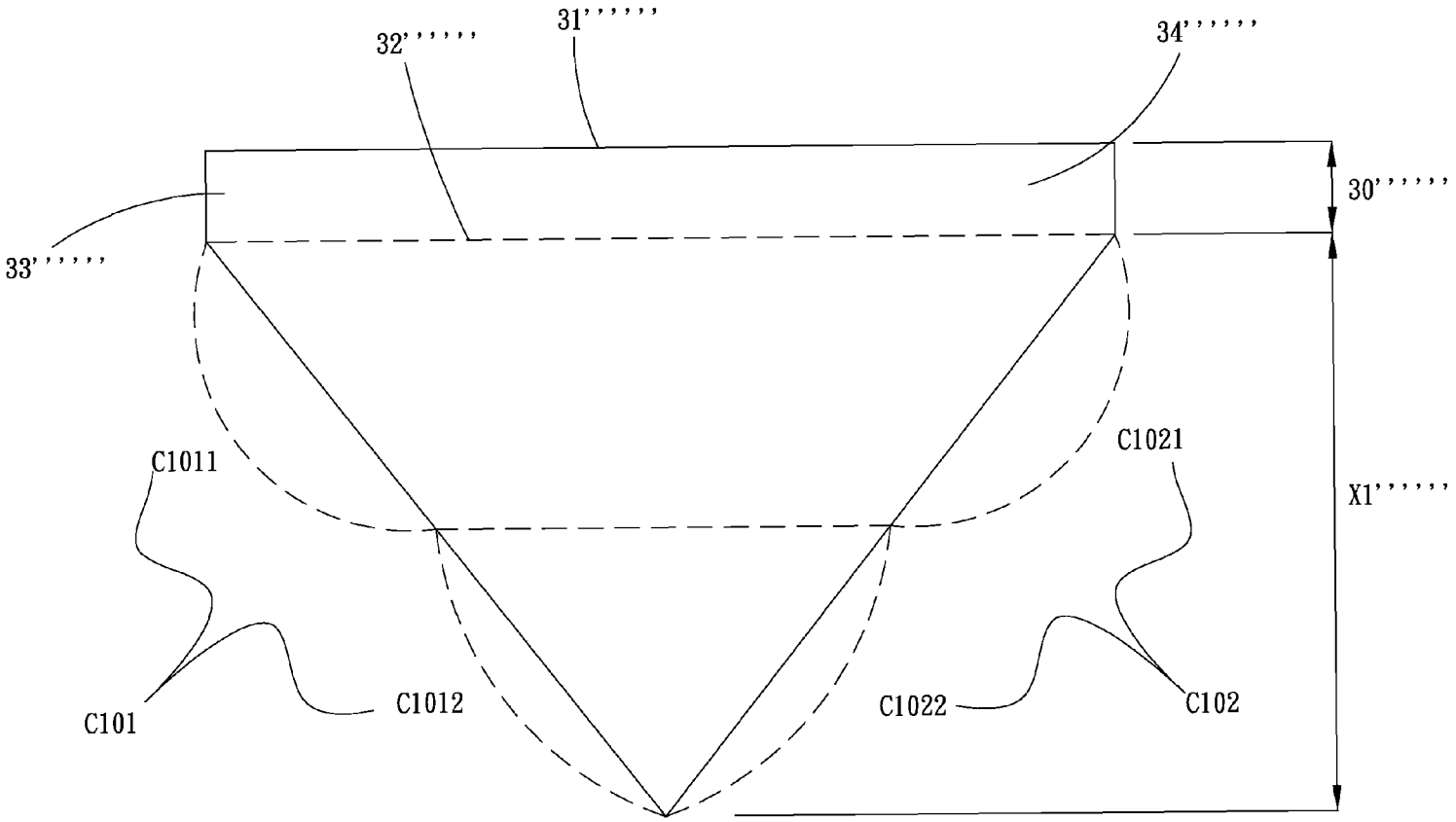
FIG. 21 is a plan view of a cut piece of fabric for forming the pouch structure of FIG. 20.

FIG. 21 is a plan view of a single piece of fabric for forming the pouch body 72 of FIG. 20. As shown, the fabric includes an encircling strip portion 30"" and a bendable panel portion X1"". The bendable panel portion X1"" includes a folding line 32"", along which the bendable panel portion X1"" adjoins the encircling strip portion 30"". The encircling strip portion 30"" is similar to those in the first and second embodiments, and includes a sewing edge 31"" for forming the connecting opening and sewing to the crotch front opening 11 of the briefs 10, a first lateral edge 33"" connected at two ends to an end of the sewing edge 31"" and of the folding line 32"" of the bendable panel portion X1"", and a second lateral edge 34"" connected at two ends to another opposite end of the sewing edge 31"" and of the folding line 32"". The second lateral edge 34"" and the first lateral edge 33"" are to be sewed together.

The bendable panel portion X1"" is shaped like a triangle or a trapezoid. In FIG. 21, the bendable panel portion X1"" is triangle-shaped, and has a first outer edge c101 and a second outer edge c102, which are laterally symmetrical. The first outer edge c101 includes a first upper segment c1011 and a first lower segment c1012; and the second outer edge c102 includes a second upper segment c1021 and a second lower segment c1022.

Figure 22:
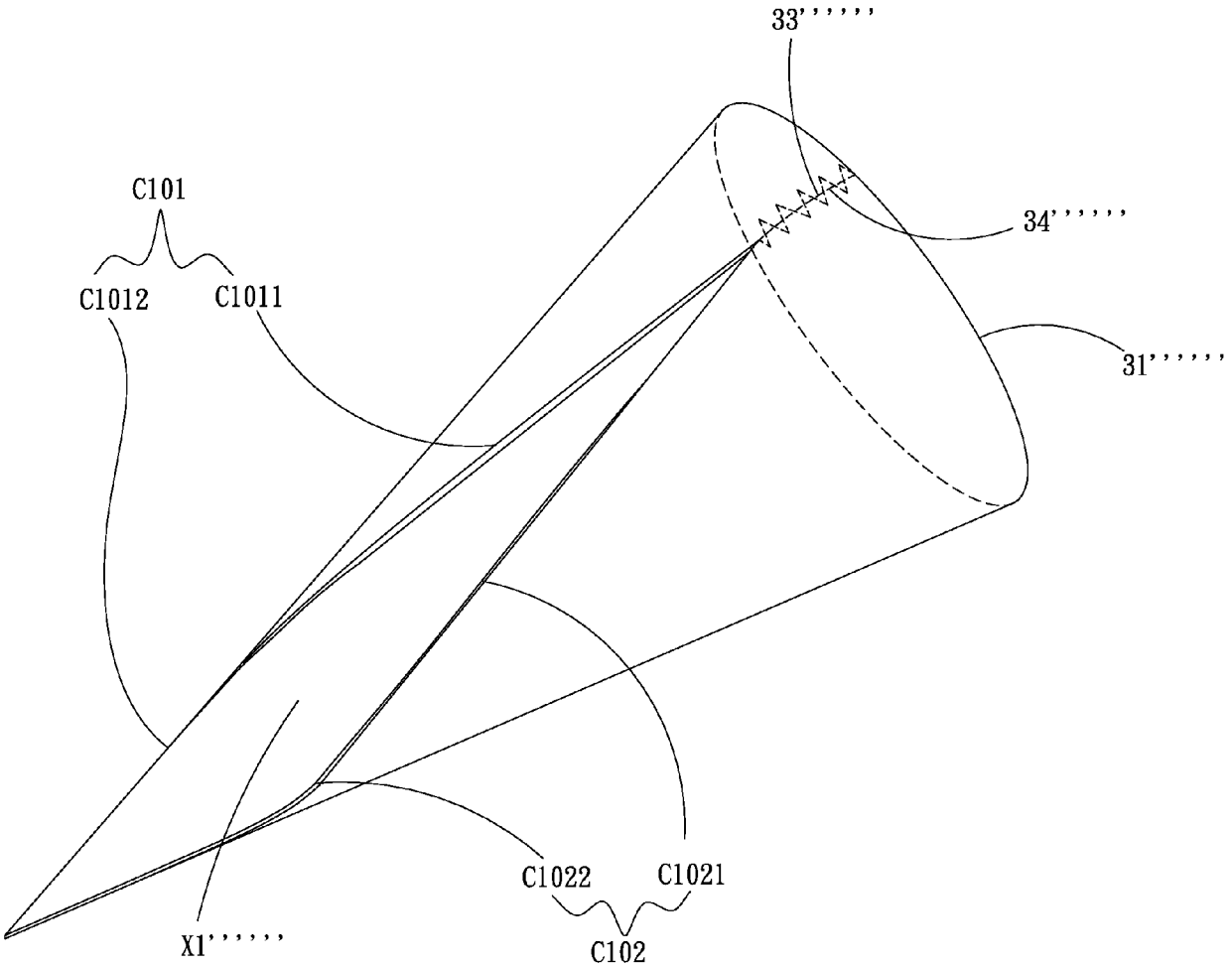
FIG. 22 is a phantom perspective view of the pouch structure of FIG. 20 in a half-finished state.
Figure 23:
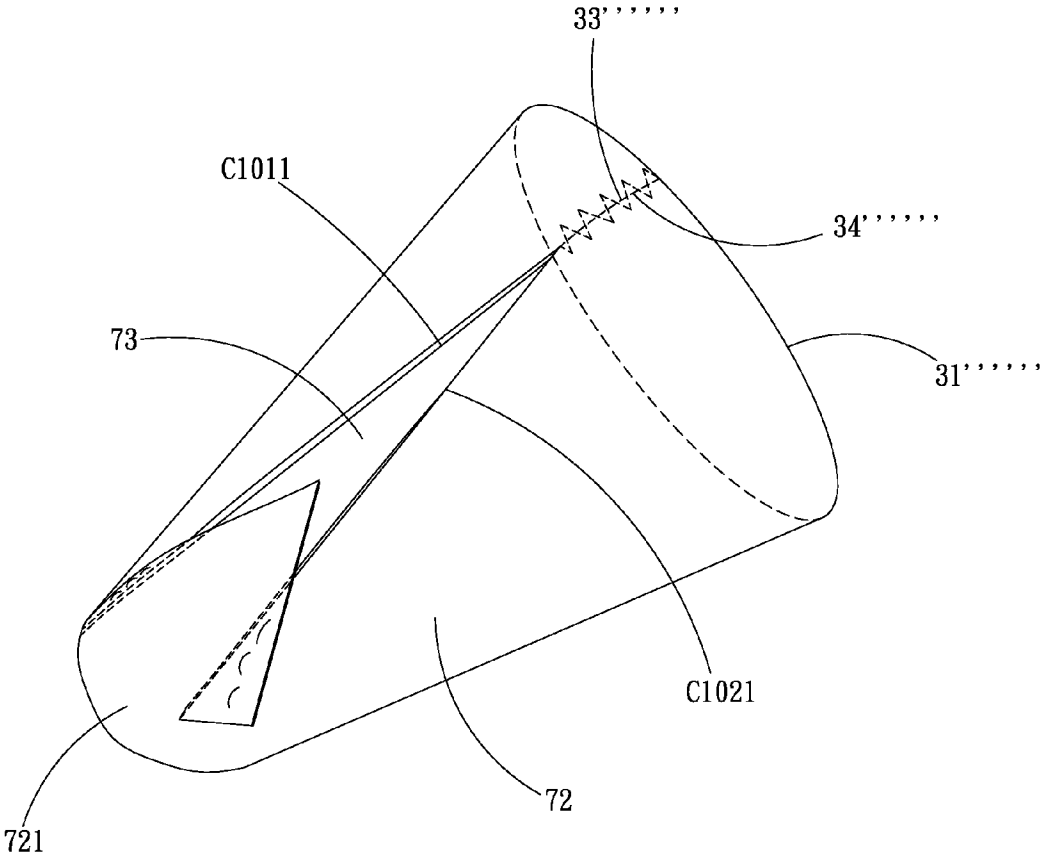
FIG. 23 is a phantom perspective view of the pouch structure of FIG. 20 in a finished state.

As shown in FIG. 22, the first lateral edge 33"" and the second lateral edge 34"" of the encircling strip portion 30"" are connected edge to edge to form the connecting opening. A bottom end of the bendable panel portion X1"" is bent upward, so that the first lower segment c1012 is brought to face and connected to a part of the first upper segment c1011 of the first outer edge c101, and similarly, the second lower segment c1022 is brought to face and connected to a part of the second upper segment c1021 of the first outer edge c102, as shown in FIG. 23.

Figure 24:
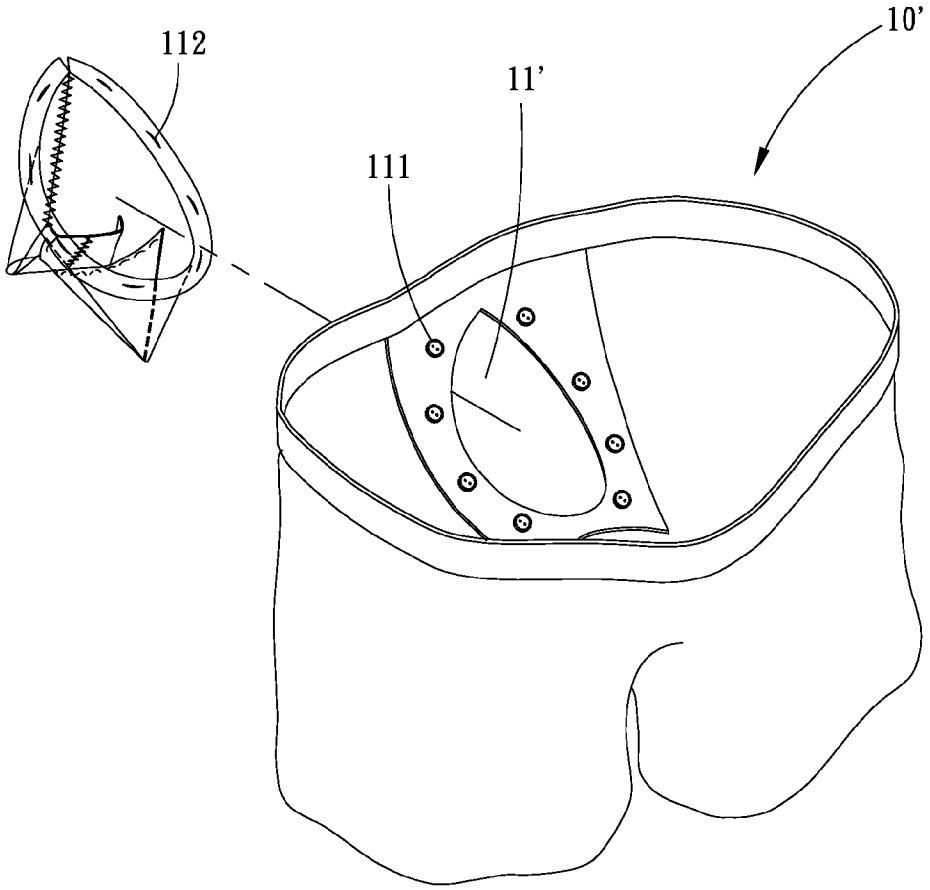
FIG. 24 is a perspective view showing the pouch structure according to the present invention can be connected to the crotch front opening of men's briefs using fastening members.
Figure 25:
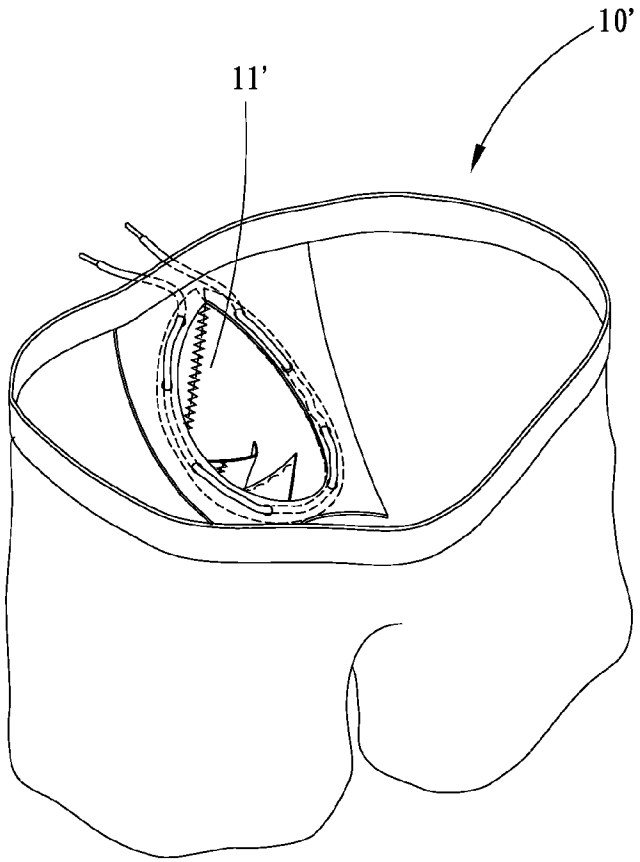
FIG. 25 is a perspective view showing the pouch structure according to the present invention can be connected to the crotch front opening of men's briefs using a string member.

According to the present invention, the connection of the connecting opening of the pouch structure to the crotch front opening 11' of the men's briefs 10' is not necessarily achieved by sewing, but can be achieved by other manners. For example, as shown in FIG. 24, at least one receiving element 112 can be provided on the connecting opening of the pouch structure for correspondingly engaging with at least one joining element 111 provided on the crotch front opening 11' of men's briefs 10' or any other conventional type of men's underpants, or vice versa. The joining element 111 can be a fastening member as shown in FIG. 24 or a string member as shown in FIG. 25. Also, the receiving element 112 can be a hole for engaging with the fastening member or the string member.

Alternatively, as a reference, according to Taiwan Patent No. M407631 or its corresponding international patent application No. PCT/CN/2012/075721, the connecting opening is not directly sewed to the crotch front opening 11' of the men's briefs 10', but further includes a front band body and/or a rear band body upward extended from the sewing edge 31 to serve as the joining element 111 for sewing to a ring-shaped waistband on men's underpants. Herein, the ring-shaped waistband serves as the receiving element 112. Also, according to the above-mentioned Taiwan Patent, the front band body and/or the rear band body and the pouch structure are tailored using a single piece of fabric.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A three-dimensionally tailored pouch structure for men's briefs comprising:

a connecting opening for connecting to a crotch front opening on men's briefs and being communicable with an inner side of the men's briefs;

a first receiving space communicable with the connecting opening and adapted to receive a wearer's penis for completely enclosing a front end of the penis therein;

a second receiving space communicable with the connecting opening and located adjacent to the first receiving space for receiving the wearer's scrotum therein;

an encircling strip portion;

a bendable panel portion located below the encircling strip portion, with the bendable panel portion having a folding line that forms a borderline between the encircling strip portion and the bendable panel portion, wherein the encircling strip portion includes a sewing edge, which forms the connecting opening, a first lateral edge having two ends connected to an end of the sewing edge and of the folding line, and a second lateral edge having two ends connected to another opposite end of the sewing edge and of the folding line, and being connected to the first lateral edge; wherein the bendable panel portion includes a first panel and a second panel, which are laterally symmetrical and shaped like two triangles; with the folding line located opposite to the sewing edge of the encircling strip portion; with the first panel including a first outer bendable panel and a first inner bendable panel, and with the second panel including a second outer bendable panel and a second inner bendable panel; with the first outer bendable panel being extended from an end of the folding line, and having a first outer edge, which is connected at an end to the first lateral edge, and at least a first cutting line, which includes a first upper segment and a first lower segment; with the second outer bendable panel extended from another opposite end of the folding line, and having a second outer edge, which is connected at an end to the second lateral edge and is sewed to the first outer edge, and at least a second cutting line, which includes a second upper segment and a second lower segment; with the first and second outer bendable panels respectively bent inward, wherein the first lower segment is located at an angle relative to the first upper segment and sewed to the first upper segment and the second lower segment is located at an angle relative to the second upper segment and sewed to the second upper segment to thereby form the first receiving space; with the first inner bendable panel extended from the folding line to locate between the first and second outer bendable panels, with the second inner bendable panel extended from the folding line to locate between the first inner bendable panel and the second outer bendable panel; and with the second inner bendable panel bent by an angle to be overlapped with and sewed to the first inner bendable panel, and wherein the second inner bendable panel cooperates with the first inner bendable panel and the encircling strip portion to form the second receiving space; and a first vent naturally formed between the first and second receiving spaces to communicate the first and second receiving spaces with an outer space.

2. The three-dimensionally tailored pouch structure for men's briefs as claimed in claim 1, wherein the encircling strip portion and the bendable panel portion are formed by sewing up a single piece of fabric.

3. The three-dimensionally tailored pouch structure for men's briefs as claimed in claim 1, wherein the first and second lateral edges of the encircling strip portion are symmetrically located at two opposite ends of the sewing edge, wherein two symmetrical angles are respectively included between the sewing edge and the first and second lateral edges; and wherein the first and second outer edges of the first and second outer bendable panels, respectively, are symmetrically located at two opposite ends of the folding line, and wherein two symmetrical angles are respectively included between the folding line and the first and second outer edges.

4. The three-dimensionally tailored pouch structure for men's briefs as claimed in claim 1, wherein the encircling strip portion is provided near and along the first and second lateral edges with a first hook and loop fastener, via which the first and second lateral edges are detachably connected to each other; and wherein the bendable panel portion is provided near and along the first outer edge of the first outer bendable panel and the second outer edge of the second outer bendable panel with a second hook and loop fastener, via which the first and second outer edges are detachably connected to each other.

5. The three-dimensionally tailored pouch structure for men's briefs as claimed in claim 1, wherein the bendable panel portion is provided at the overlapped area between the first and second inner bendable panels with a third hook and loop fastener, via which the first and second inner bendable panels are detachably connected to each other.

6. The three-dimensionally tailored pouch structure for men's briefs as claimed in claim 1, wherein the second receiving space has a second vent communicating the second receiving space with an outer space.

7. The three-dimensionally tailored pouch structure for men's briefs as claimed in claim 1, wherein the first panel has first and second cutting lines defined thereon, wherein a notch is formed between the first and second cutting lines; wherein the second panel has third and fourth cutting lines defined thereon, wherein another notch is formed between the third and fourth cutting lines; and wherein the first and second outer edges sewed to each other respectively have a section adjacent to a bottom thereof that are not sewed together to thereby form an opening thereat.

8. The three-dimensionally tailored pouch structure for men's briefs as claimed in claim 7, wherein the first receiving space has an inner side that forms an opening for communicating the first receiving space with the outer space.

9. The three-dimensionally tailored pouch structure for men's briefs as claimed in claim 2, wherein the bendable panel portion includes a first outer bendable panel, a second outer bendable panel, and a middle bendable panel located between the first and second outer bendable panels; with a first cutting line defined between the first outer bendable panel and the middle bendable panel, with a second cutting line defined between the second outer bendable panel and the middle bendable panel; with the middle bendable panel turned inward to bend two lateral sides thereof, with the two lateral sides then respectively closed up to form the first receiving space; and with the first and second outer bendable panels bent to overlap each other and then connected together to form the second receiving space.

10. The three-dimensionally tailored pouch structure for men's briefs as claimed in claim 1, wherein one of the connecting opening of the pouch structure and the crotch front opening of the men's briefs is provided with at least one joining element, and wherein another one is provided with at least one receiving element corresponding to the at least one joining element.

* * * * *